US009463487B2

(12) United States Patent
Tanaka

(10) Patent No.: US 9,463,487 B2
(45) Date of Patent: Oct. 11, 2016

(54) DISCHARGE SYSTEM

(71) Applicant: HEISHIN LTD., Hyogo (JP)

(72) Inventor: Yusuke Tanaka, Hyogo (JP)

(73) Assignee: HEISHIN LTD., Hyogo (JP)

( * ) Notice: Subject to any disclaimer, the term of this patent is extended or adjusted under 35 U.S.C. 154(b) by 0 days.

(21) Appl. No.: 14/433,013

(22) PCT Filed: Oct. 1, 2013

(86) PCT No.: PCT/JP2013/076751
§ 371 (c)(1),
(2) Date: Apr. 1, 2015

(87) PCT Pub. No.: WO2014/054663
PCT Pub. Date: Apr. 10, 2014

(65) Prior Publication Data

US 2015/0266048 A1 Sep. 24, 2015

(30) Foreign Application Priority Data

Oct. 1, 2012 (JP) ..... 2012-219346

(51) Int. Cl.
*B05C 11/10* (2006.01)
*B05C 5/02* (2006.01)
*B05C 5/00* (2006.01)

(52) U.S. Cl.
CPC ..... *B05C 11/1013* (2013.01); *B05C 5/00* (2013.01); *B05C 5/0212* (2013.01); *B05C 5/0225* (2013.01); *B05C 5/001* (2013.01)

(58) Field of Classification Search
CPC ... B05C 11/1013; B05C 5/00; B05C 5/0212; B05C 5/0225
USPC ..... 222/256, 372, 381, 412, 52, 63, 64, 222/410, 411; 118/323; 239/73, 451, 332; 901/43
See application file for complete search history.

(56) References Cited

U.S. PATENT DOCUMENTS 4,659,018 A * 4/1987 Shulman ..... B25J 9/105 239/225.1
4,822,647 A * 4/1989 Nozaki ..... B05C 11/10 118/674

(Continued)

FOREIGN PATENT DOCUMENTS

JP H09-119567 A 5/1997
JP H11-011598 A 1/1999

(Continued)

OTHER PUBLICATIONS

International Search Report; PCT/JP2013/076751; Nov. 12, 2013.

*Primary Examiner* — Donnell Long
(74) *Attorney, Agent, or Firm* — Studebaker & Brackett PC

(57) ABSTRACT

The adhesion of a fluid to a connecting device for connecting a discharge device and a filling device to each other so as to fill the fluid into the discharge device is suppressed. A discharge system includes a discharge device capable of being filled with a fluid for discharge and discharging the fluid, a filling device for filling the fluid into the discharge device, a connecting device for connecting the discharge device and the filling device to each other in a separable manner, and a control device. The control device of the discharge system controls an operation speed during a separating operation of separating the discharge device from the filling device to be equal to or less than an operation speed during a connecting operation of connecting the discharge device to the filling device.

10 Claims, 16 Drawing Sheets

(56) References Cited

U.S. PATENT DOCUMENTS 5,046,666 A * 9/1991 Ono ..... B05C 5/02 239/119
5,165,961 A * 11/1992 Freeman ..... B05C 11/10 118/323
6,068,201 A * 5/2000 Hawley ..... B05B 13/04 118/323
6,197,115 B1 * 3/2001 Barrey ..... B05C 11/10 118/500
6,695,923 B1 * 2/2004 Schultz ..... B05B 13/0431 118/323
6,726,773 B1 * 4/2004 Yanagita ..... B05B 9/047 118/323
8,397,662 B2 * 3/2013 Herre ..... B05B 13/0221 118/300
2006/0169202 A1 * 8/2006 Erickson ..... B05B 7/02 118/323
2008/0210706 A1 * 9/2008 Geier ..... G05D 7/0676 222/1
2011/0033279 A1 * 2/2011 Akamatsu ..... F04C 2/1073 415/72
2013/0032090 A1 * 2/2013 Yano ..... B05C 5/001 118/706
2013/0327269 A1 12/2013 Suhara

FOREIGN PATENT DOCUMENTS

JP 2004-154733 A 6/2004
JP 2004-345697 A 12/2004
JP 2007-275769 A 10/2007
JP 2012-120938 A 6/2012
WO 2012/077650 A1 6/2012

* cited by examiner (a)

(b)

(c)

(a)

(b)

(c)

DISCHARGE SYSTEM

TECHNICAL FIELD

The present invention relates to a discharge device that can be used for purposes of applying a fluid such as a sealant or an adhesive to various components in an automobile assembly plant or the like, filling a fluid such as grease into a container, and the like.

BACKGROUND ART

Hitherto, an application device and an application method for a functional fluid disclosed in Patent Literature 1, a joint for a fluid and an application device disclosed in Patent Literature 2, or the like are used for purposes of applying a fluid such as a sealant or an adhesive to various components in an automobile assembly plant or the like. The application device according to Patent Literature 1 includes an application unit and a filling unit. In this application device, the application unit includes a discharge gun for discharging a functional fluid and a feeder for feeding the functional fluid to the discharge gun. Further, the filling unit fills the functional fluid into a filling cylinder through a filling port. With such a configuration, a pipe having a long distance for feeding the functional fluid up to the discharge gun is made unnecessary to significantly shorten the length of the pipe, and a temperature regulator for regulating the temperature of the fluid and a fluid feed pump are limited to the minimum requirement.

Further, the joint for a fluid and the application device disclosed in Patent Literature 2 also aim at making it unnecessary to use a large-scale pipe facility for feeding a fluid from a tank to a discharger and a high-pressure pump for transferring the fluid in the same way as in Patent Literature 1. In the related art of Patent Literature 2, there are provided first to third feed portions for feeding a fluid such as a sealant and first to third dischargers mounted in a removable manner on the respective first to third feed portions and the like through intermediation of joints for a fluid. Further, each of the first to third dischargers includes a tank for storing the fluid fed from the corresponding feed portion on which the discharger is mounted, and thus the fluid in the tank can be discharged. Further, each of the first to third dischargers can be mounted in a removable manner on a robot arm through intermediation of a second joint.

CITATION LIST

Patent Literature

[PTL 1] JP 2004-154733 A
[PTL 2] JP 2007-275769 A

SUMMARY OF INVENTION

Technical Problem

As described above, there have been provided various discharge systems in which a discharge device for discharging a fluid for discharge and a filling device for filling the fluid into the discharge device are provided so as to be connected to and separated from each other, and the fluid can be filled into the discharge device side from the filling device side by connecting the discharge device and the filling device to each other. In the above-mentioned discharge systems, there is a risk in that, when the discharge device and the filling device are connected to each other and then separated from each other, the fluid may adhere in a large amount to a surface of a connecting device such as a coupler provided in both the discharge device and the filling device. When the discharge device and the like are operated with the fluid adhering to the connecting device, there is a risk in that the fluid may drop to a position outside of a portion to which the fluid is to be discharged. However, in the related art, the adhesion of the fluid to the connecting device during the connection and separation of the discharge device and the filling device is not taken into consideration, and thus sufficient countermeasures have not been taken.

In view of the foregoing, it is an object of the present invention to provide a discharge system capable of suppressing the adhesion of a fluid to a connecting device for connecting a discharge device and a filling device to each other so as to fill the fluid into the discharge device.

Solution to Problem

In order to solve the above-mentioned problem, according to one embodiment of the present invention, there is provided a discharge system, including: a discharge device capable of discharging a fluid; a filling device capable of filling the fluid into the discharge device; and a control device. The fluid is filled into the discharge device side from the filling device side by connecting the discharge device and the filling device to each other. The fluid is dischargeable from the discharge device in a state in which the discharge device and the filling device are separated from each other. An operation speed during a connecting operation and an operation speed during a separating operation are controlled based on an operation speed control signal output from the control device, the connecting operation connecting the discharge device to the filling device, the separating operation separating the discharge device from the filling device that have been connected to each other. The operation speed control signal is output from the control device so that the operation speed during the separating operation becomes equal to or less than the operation speed during the connecting operation.

The inventor of the present invention earnestly conducted studies on the measures for shortening a step operation time required for connecting and separating the discharge device and the filling device while preventing the adhesion of the fluid to the connecting device during the filling operation of the fluid into the discharge device. As a result, the inventor has found that it is effective to control the operation so that the operation speed during the separating operation becomes lower than the operation speed during the connecting operation. Specifically, the inventor has found that it is effective to decrease the connection speed and the separation speed of the discharge device and the filling device in order to prevent the adhesion of the fluid to the connecting device. On the other hand, it is necessary to shorten a period of time required for the filling operation of the fluid in order to enhance operation efficiency. The inventor further earnestly conducted studies so as to solve the above-mentioned problem and has found that, when the operation speed during the connecting operation is set to be higher than the operation speed during the separating operation, the fluid is scraped off in the connecting device, and thereby the leakage and adhesion of the fluid are likely to be prevented.

The present invention has been achieved based on the above-mentioned findings. The operation speed control signal is output from the control device during the connecting operation and the separating operation of the discharge device and the filling device so as to control the operation speed during the separating operation to be equal to or lower than the operation speed during the connecting operation. By performing such an operation control, the fluid may be sufficiently scraped off in the connecting device during the separating operation, and thereby the leakage amount and the adhesion amount of the fluid to an outside may be minimized.

In the discharge system according to the one embodiment of the present invention, it is desired that the discharge device and/or the filling device include a buffer for buffering an internal pressure variation caused by connection and/or separation of the discharge device and the filling device.

As a result of the earnest studies by the inventor, it has been found that, when the internal pressures in the discharge device and the filling device are high during the connecting operation and the separating operation of the discharge device and the filling device, there is a high risk in that the fluid may leak and adhere to an outside of the connecting device. The present invention has been achieved based on the above-mentioned finding. The buffer for buffering the internal pressure variation is provided in one or both of the discharge device and the filling device, and thereby the internal pressure variation caused by the connection and separation of the discharge device and the filling device is buffered, and the connecting and separating operations may thus be performed under a low-pressure condition. Thus, according to the discharge system of the one embodiment of the present invention, such a situation may be suppressed that the fluid leaks to an outside of the connecting device to adhere to a surface thereof and the like during the connecting operation and the separating operation of the discharge device and the filling device.

In the discharge system according to the one embodiment of the present invention, the buffer may include an absorber mechanism including a casing, a piston mounted in the casing in a slidable manner, and biasing means for biasing the piston. An inside of the casing may be partitioned by the piston into a first chamber and a second chamber that allows outflow and inflow of the fluid, and the piston may be biased by the biasing means in a direction of reducing a capacity of the second chamber.

According to the above-mentioned configuration, the internal pressure variation in the discharge device and the filling device caused by the connecting and separating operations may be minimized, and the connecting and separating operations may be performed under a low-pressure condition. With this, such a problem may be minimized that the fluid leaks to an outside of the connecting device to adhere to a surface thereof and the like during the connecting operation and the separating operation of the discharge device and the filling device.

In the discharge system according to the one embodiment of the present invention, the buffer may include a cylinder mechanism including a casing, a piston mounted in the casing in a slidable manner, and a driving source for slidably driving the piston. An inside of the casing may be partitioned by the piston into a first chamber and a second chamber that allows outflow and inflow of the fluid, and a capacity of the second chamber may be capable of being varied by operating the driving source.

According to the above-mentioned configuration, the internal pressure variation caused by the connecting and separating operations of the discharge device and the filling device is suppressed, and the connecting and separating operations may be performed under a low-pressure condition. With this, the fluid may be prevented from leaking and adhering to an outside during the connecting and separating operations of the discharge device and the filling device.

Further, in the discharge system according to the one embodiment of the present invention, the buffer may include a tank capable of allowing outflow and inflow of the fluid.

According to the above-mentioned configuration, the internal pressure variation in the discharge device and the filling device caused by the connecting and separating operations is minimized, and the connecting and separating operations may be performed under a low-pressure condition. With this, the leakage and adhesion of the fluid in the connecting device may be suppressed.

In the discharge system according to the one embodiment of the present invention, it is desired that the discharge system further include a separation preventing mechanism for preventing separation of the discharge device connected to the filling device.

According to the above-mentioned configuration, even when the fluid is pumped from the filling device side to the discharge device side after the connection of the filling device side and the discharge device, the discharge device may be prevented from being separated from the filling device.

Further, in the discharge system according to the one embodiment of the present invention, it is desired that the discharge device include a uniaxial eccentric screw pump including: an external thread-shaped rotor that receives power to rotate eccentrically; and a stator having an inner circumferential surface formed into an internal thread shape.

In the discharge system of the one embodiment of the present invention, the discharge device includes the uniaxial eccentric screw pump, and hence the fluid may be discharged quantitatively and stably without pulsating and the like. Further, as described above, the discharge system according to the one embodiment of the present invention may prevent the adhesion of the fluid to the connecting device during the connection and separation of the discharge device and the filling device. With this, when the discharge device is operated so as to apply the fluid to various articles and the like, such a trouble may be avoided that the fluid adhering to the connecting device drops. Thus, according to the one embodiment of the present invention, the discharge system may be provided, which exhibits extremely excellent characteristics in terms of discharge performance of the fluid.

Advantageous Effects of Invention

According to the one embodiment of the present invention, it is possible to provide the discharge system capable of suppressing the adhesion of the fluid to the connecting device for connecting the discharge device and the filling device to each other so as to fill the fluid into the discharge device.

BRIEF DESCRIPTION OF DRAWINGS

FIGS. 2(*a*), 2(*b*), 2(*c*), 2(*d*), and 2(*e*) are a left side view, a front view, a sectional view, a plan view, and a perspective view, respectively.

3(*a*), 3(*b*) , 3(*c*), and 3(*d*) are a front view, a sectional view, a perspective view, and a plan view, respectively.

Figure 2:
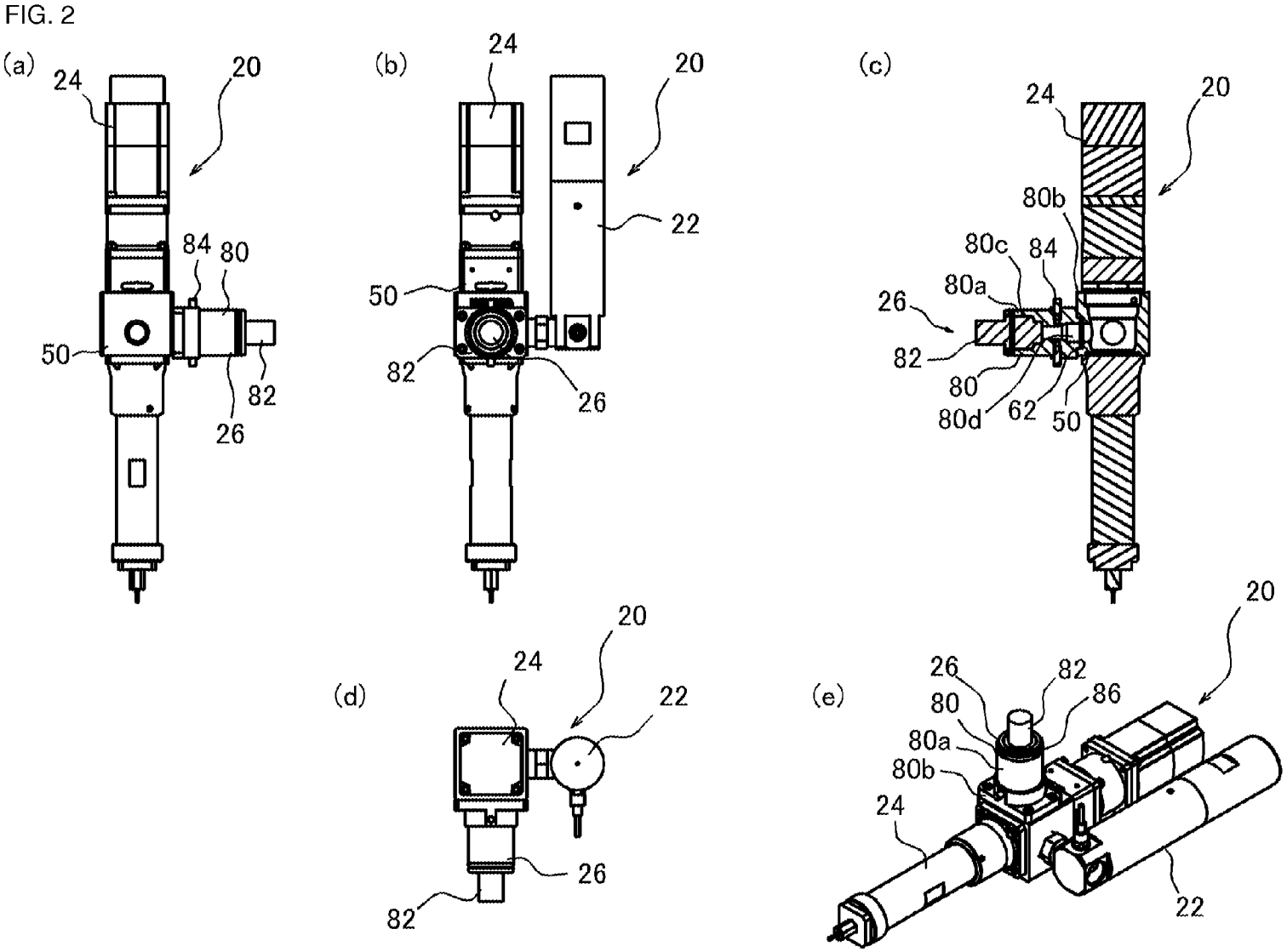
FIG. 2 are views each illustrating a discharge device adopted in the discharge system of FIG. 1.
Figure 4:
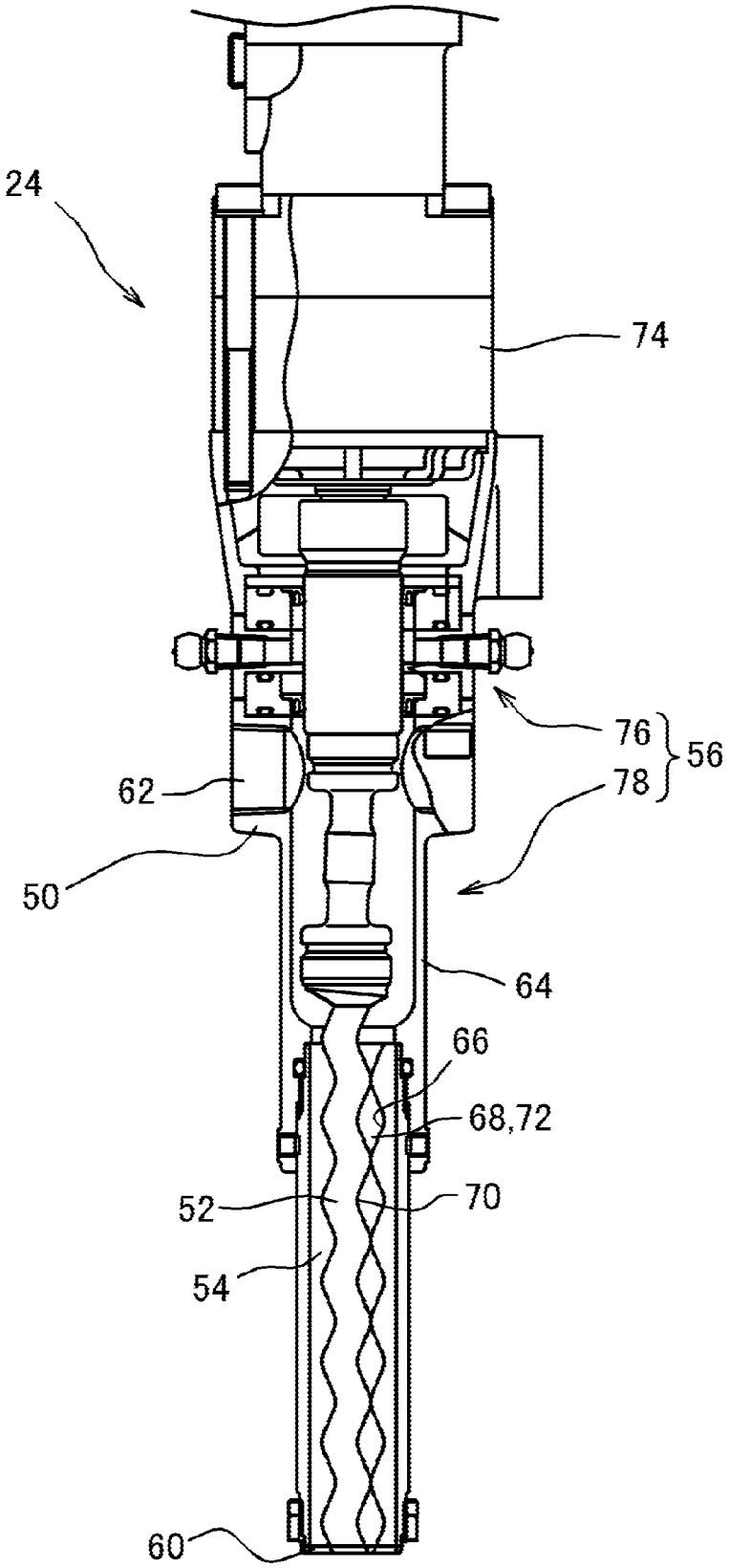

FIG. 4 is a sectional view illustrating a structure of a discharge portion adopted in the discharge device of FIG. 2.

Figure 1:
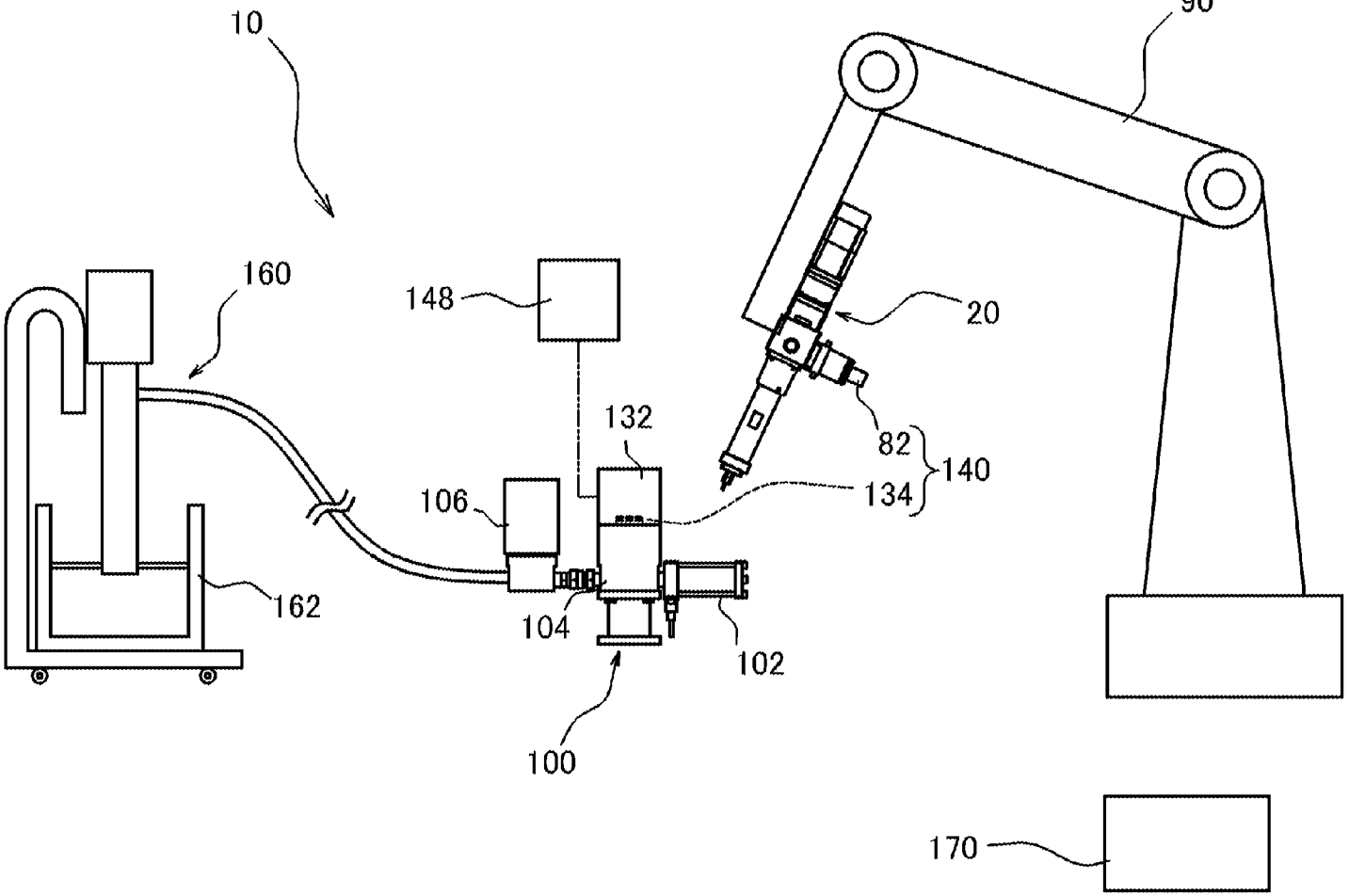
FIG. 1 is an explanatory diagram illustrating an overview of a discharge system according to an embodiment of the present invention.
Figure 5:
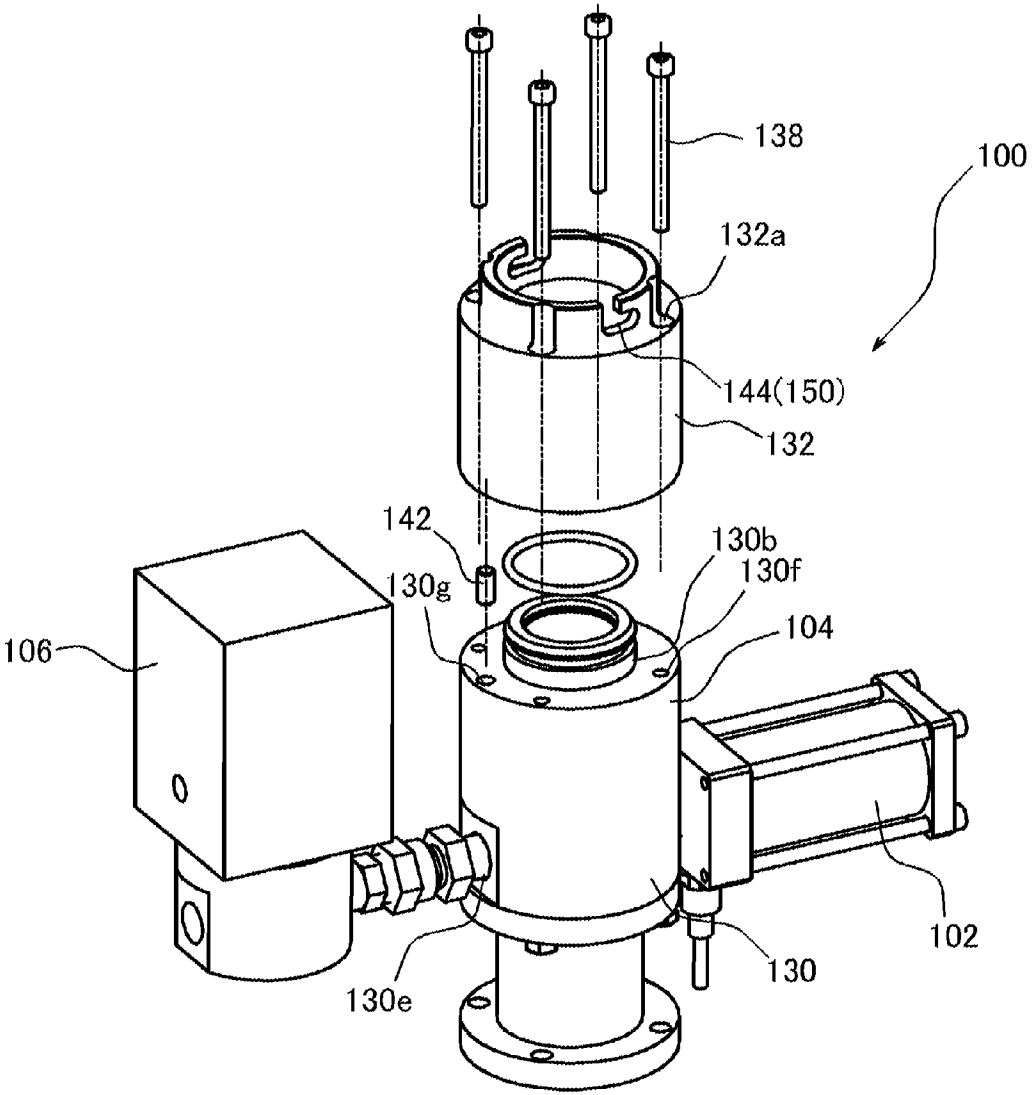

FIG. 5 is an exploded perspective view of a filling device adopted in the discharge system of FIG. 1.

Figure 6:
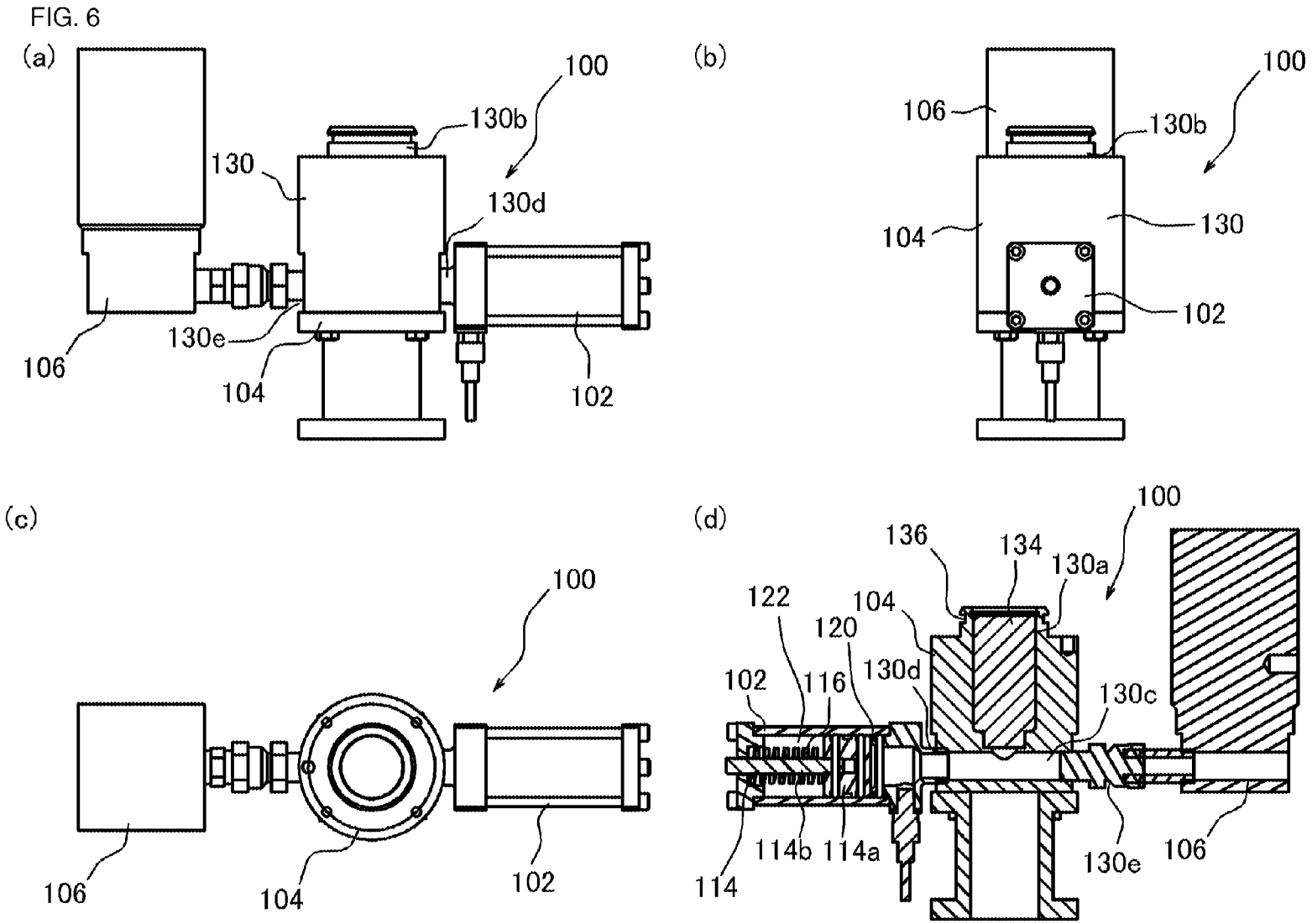

FIG. 6 are views each illustrating a region of the filling device of FIG. 5 excluding a sealed space forming member. FIGS. 6(*a*), 6(*b*), 6(*c*), and 6(*d*) are a front view, a right side view, a plan view, and a sectional view, respectively.

Figure 7:
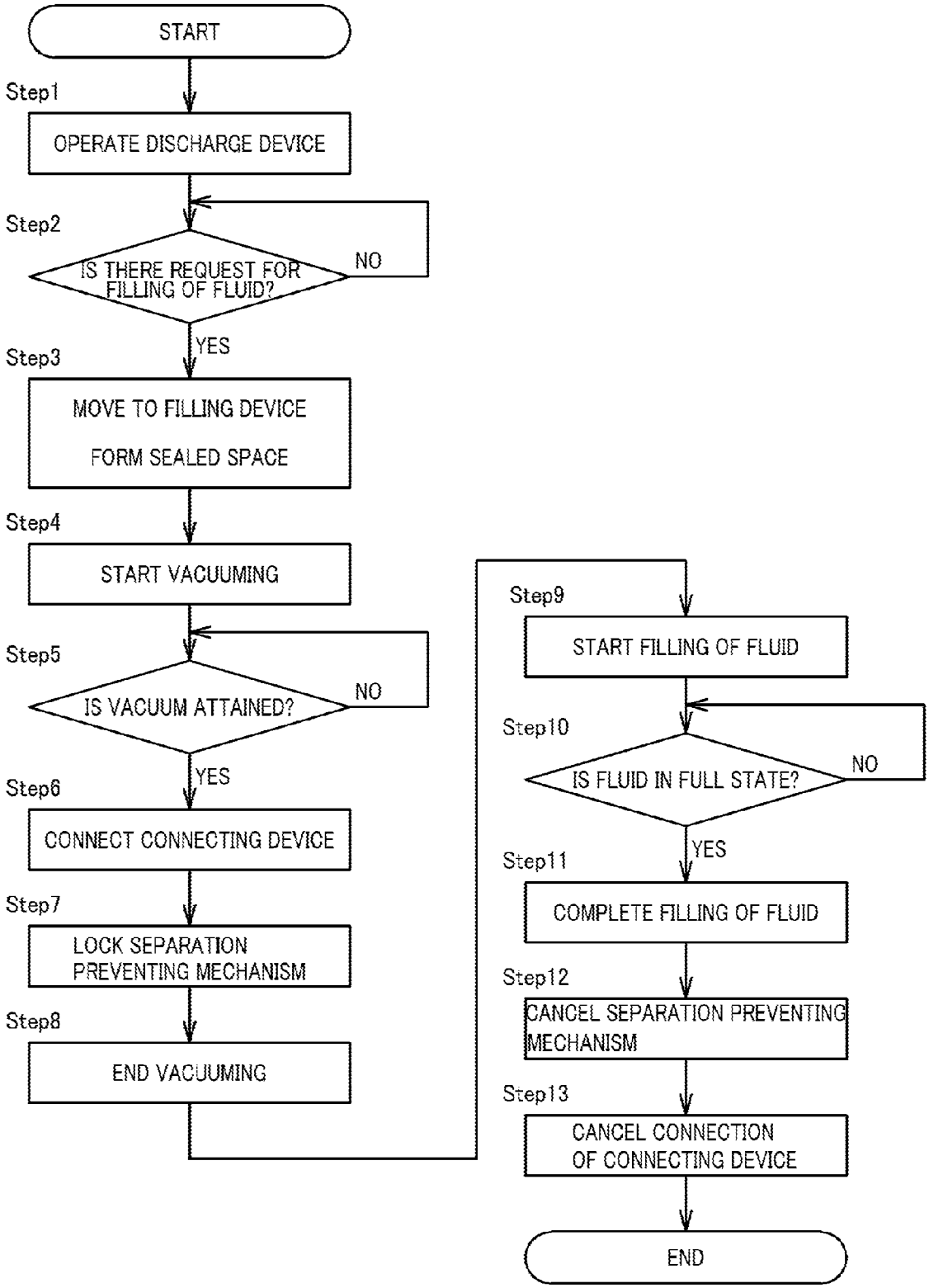

FIG. 7 is a flowchart illustrating an operation of the discharge system of FIG. 1.

Figure 8:
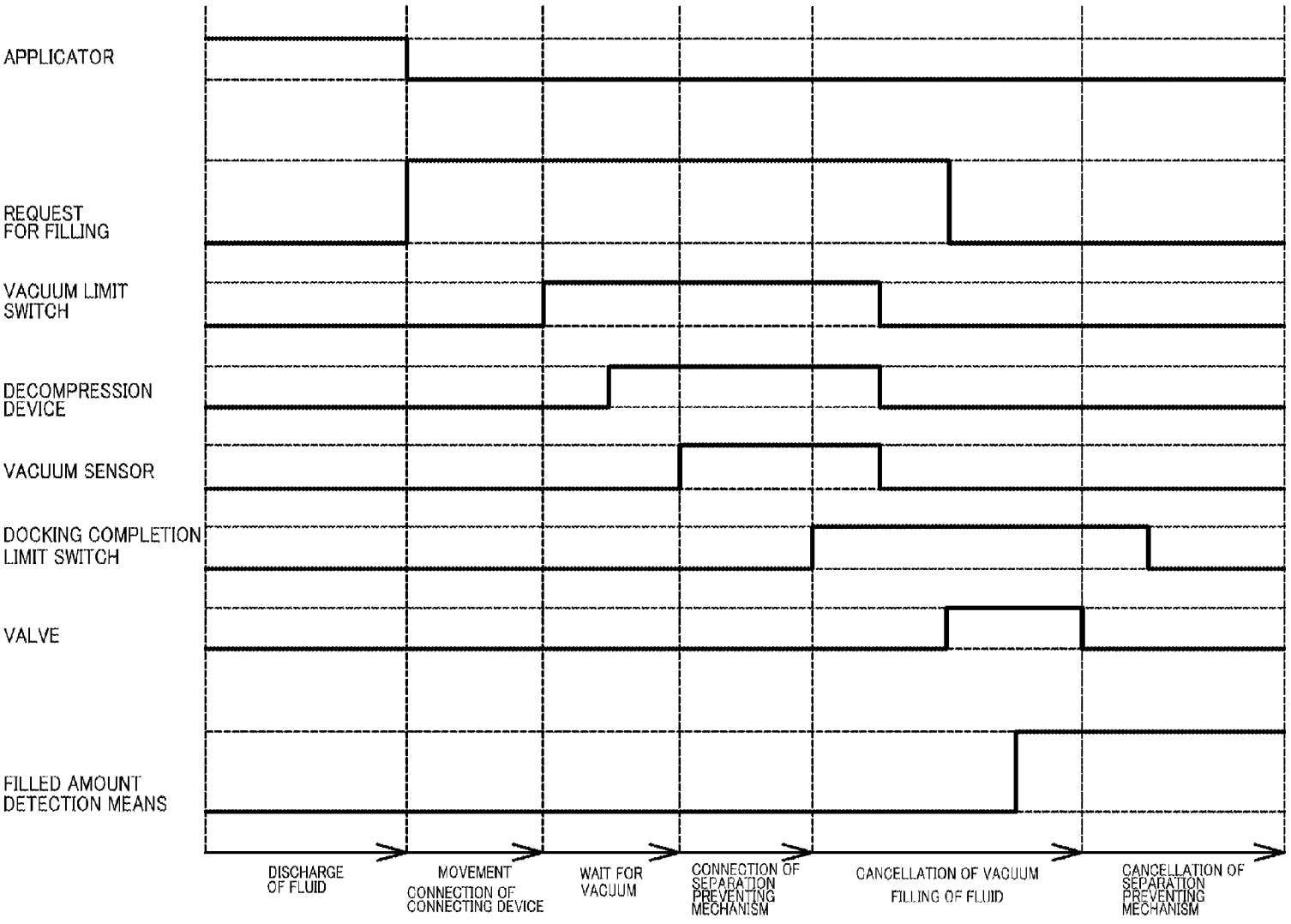

FIG. 8 is a timing chart illustrating the operation of the discharge system of FIG. 1.

Figure 9:
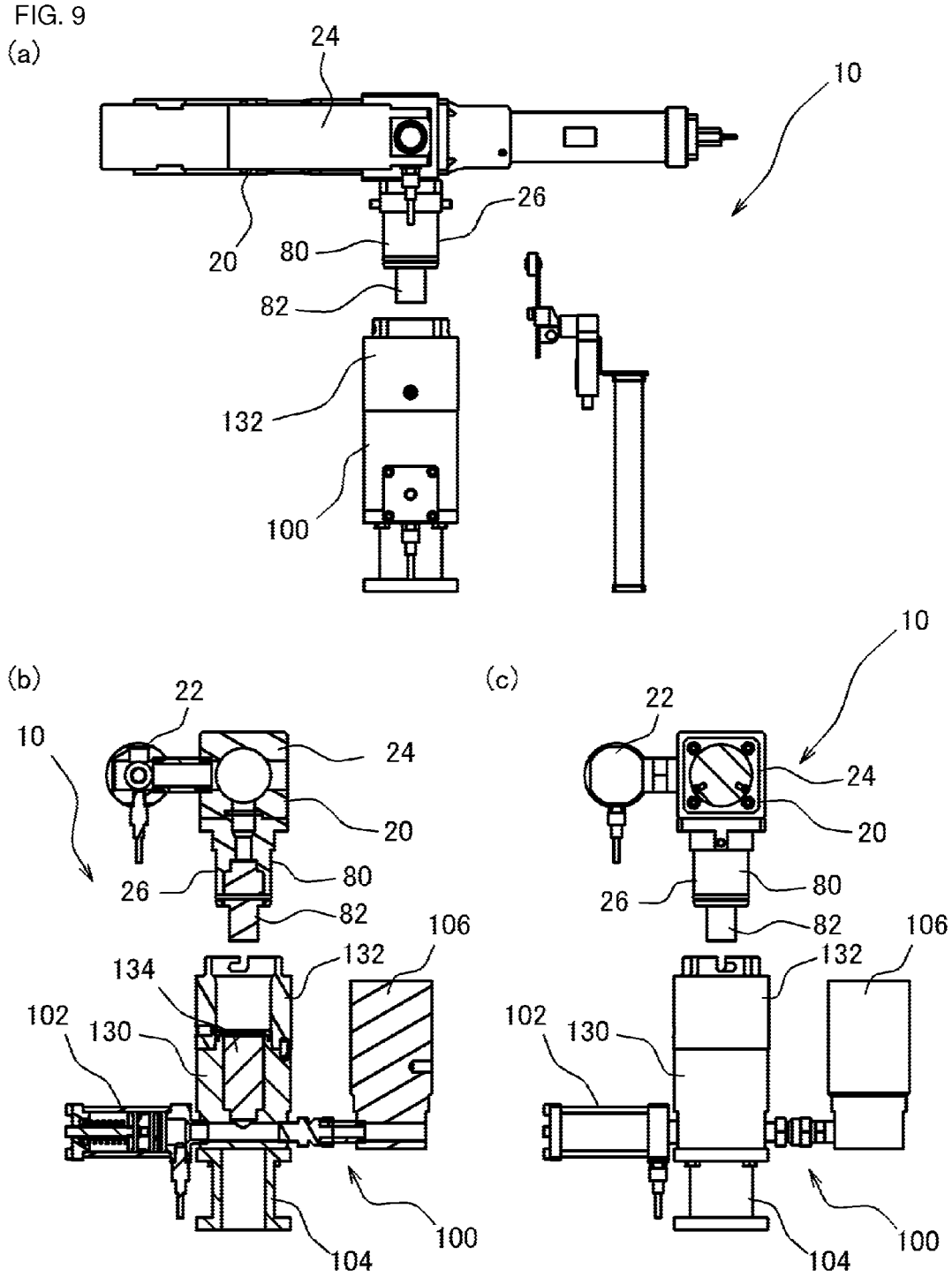

FIG. 9 are views each illustrating a first stage of the operation of the discharge system of FIG. 1. FIGS. 9(*a*), 9(*b*), and 9(*c*) are a side view, a sectional view in a state viewed from the front, and a front view, respectively.

Figure 10:
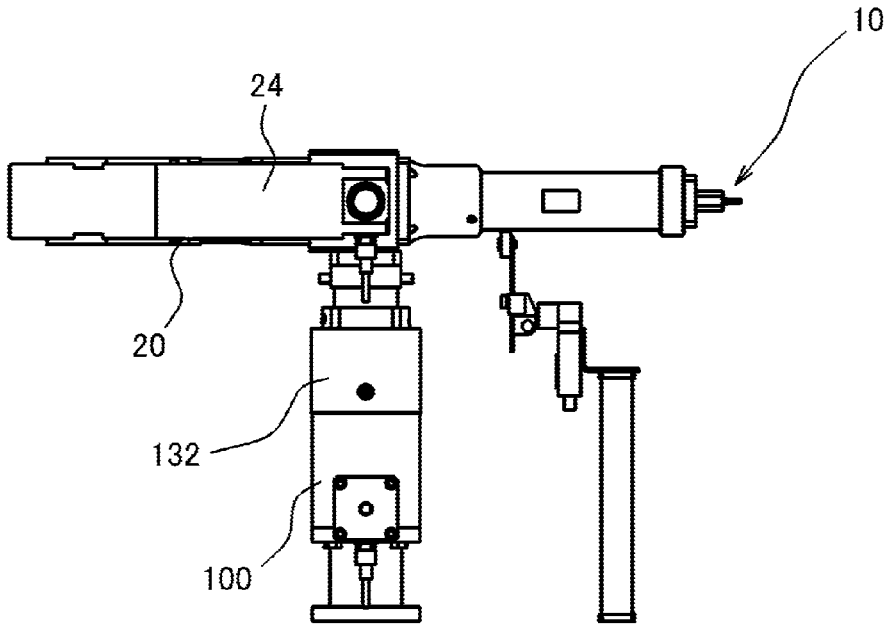
Figure 10:
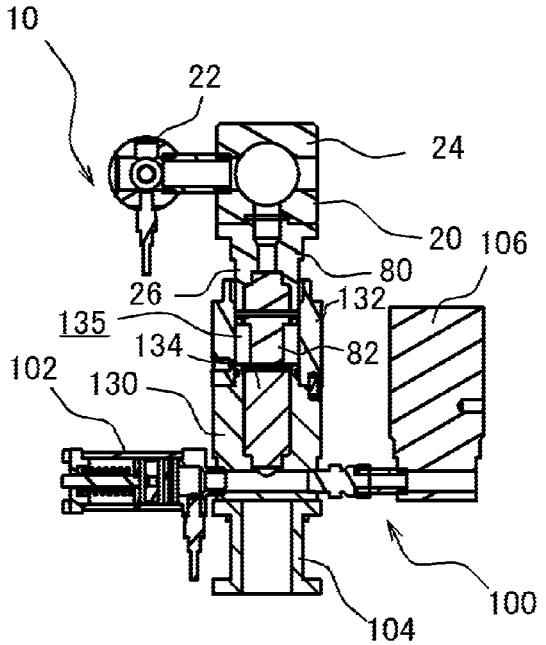
Figure 10:
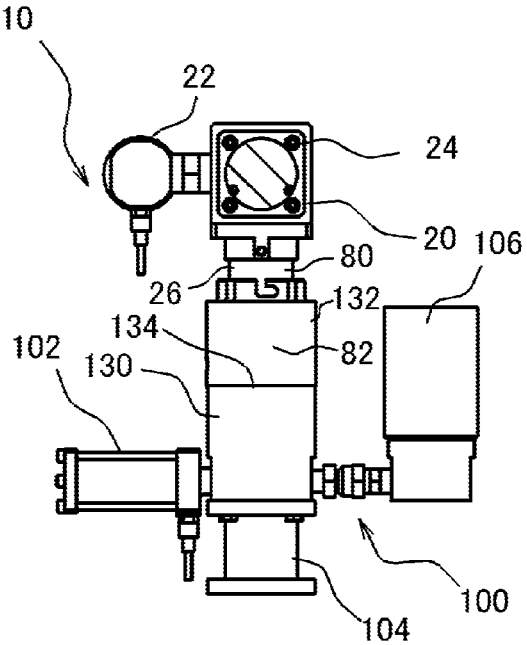

FIG. 10 are views each illustrating a second stage of the operation of the discharge system of FIG. 1. FIGS. 10(*a*), 10(*b*), and 10(*c*) are a side view, a sectional view in a state viewed from the front, and a front view, respectively.

Figure 11:
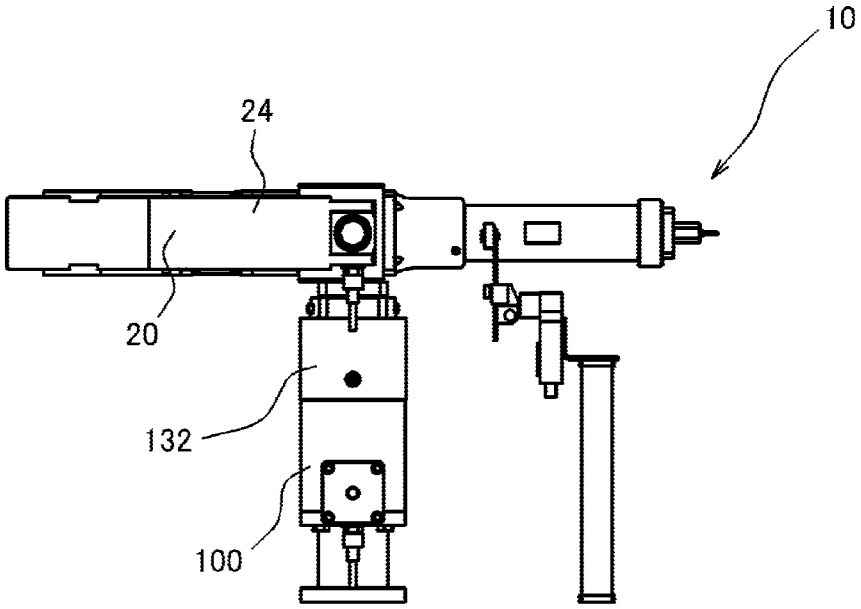
Figure 11:
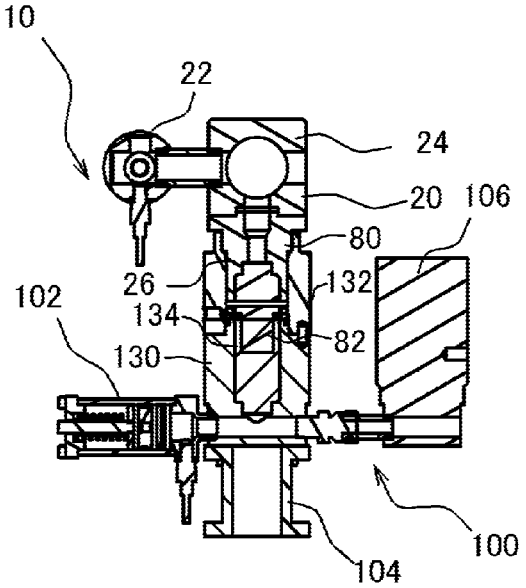
Figure 11:
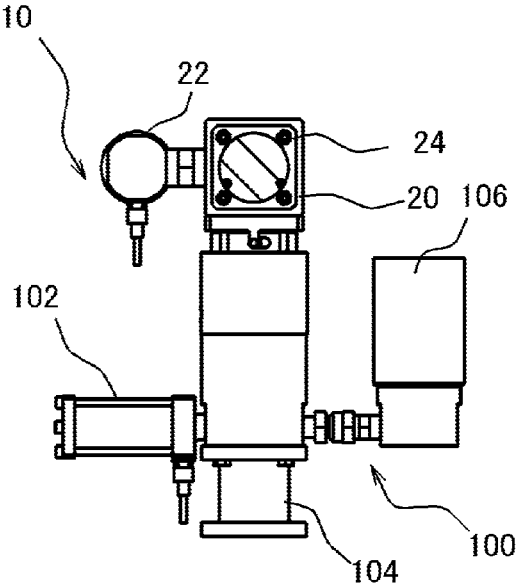

FIG. 11 are views each illustrating a third stage of the operation of the discharge system of FIG. 1. FIGS. 11(*a*), 11(*b*), and 11(*c*) are a side view, a sectional view in a state viewed from the front, and a front view, respectively.

Figure 12:
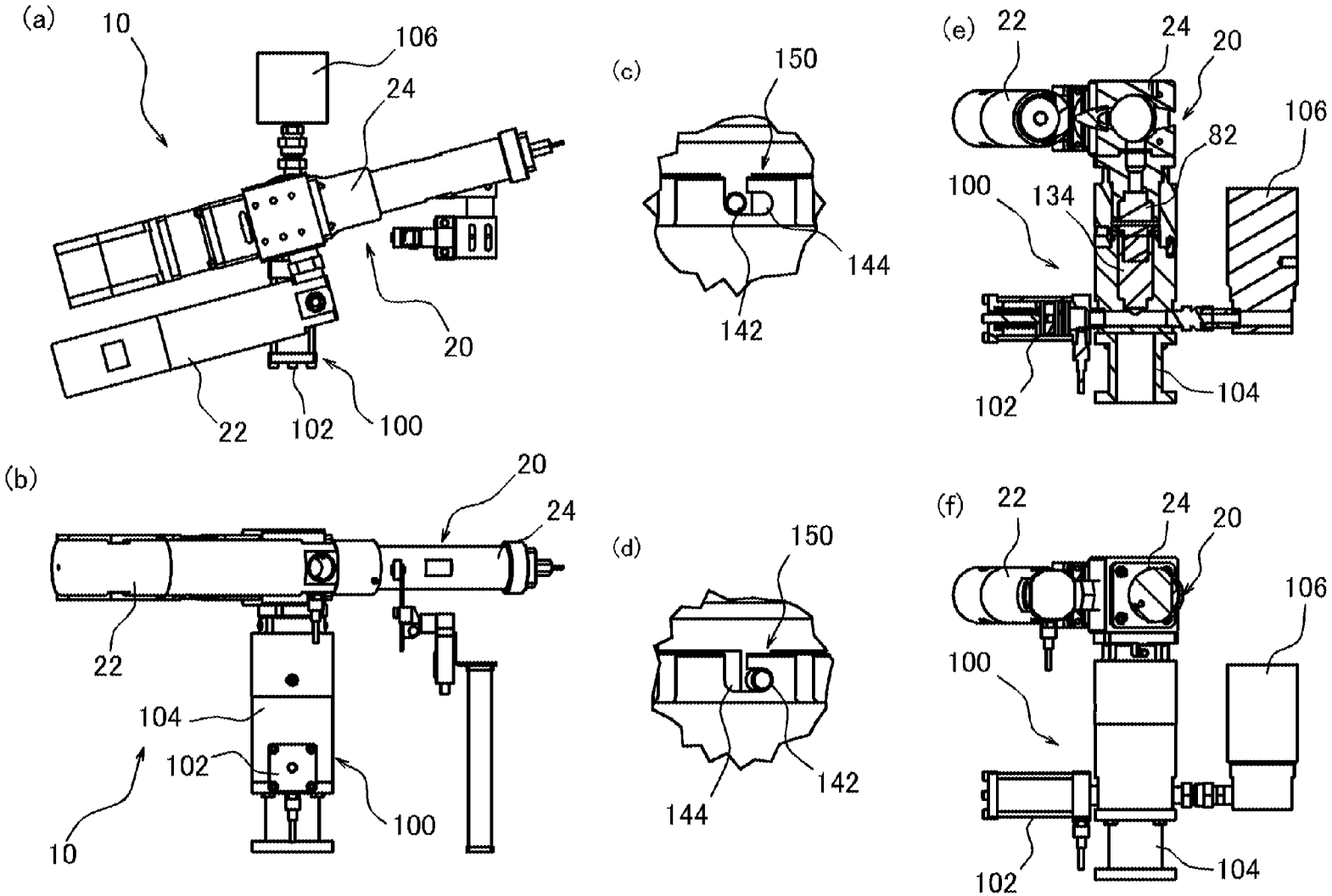

FIGS. 12(*a*) and 12(*b*) are respectively plan views in a fourth stage and a fifth stage of the operation of the discharge system of FIG. 1; FIGS. 12(*c*) and 12(*d*) are respectively enlarged views illustrating a state of a separation preventing mechanism in the fourth stage and the fifth stage of the operation; and FIGS. 12(*e*) and 12(*f*) are respectively sectional views in the fourth stage and the fifth stage of the operation.

Figure 13:
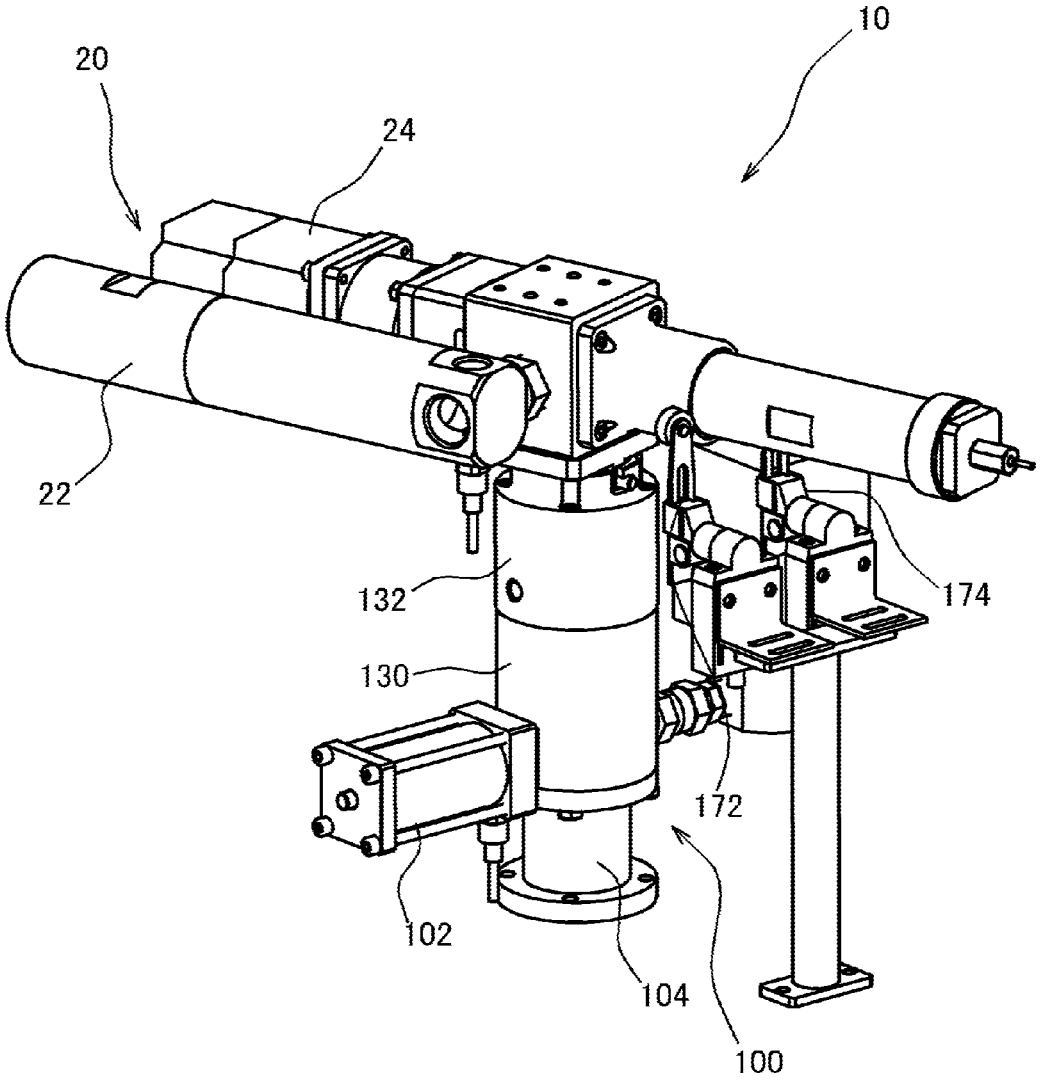

FIG. 13 is a perspective view illustrating a state in which the discharge device and the filling device are connected to each other in the discharge system of FIG. 1.

Figure 14:
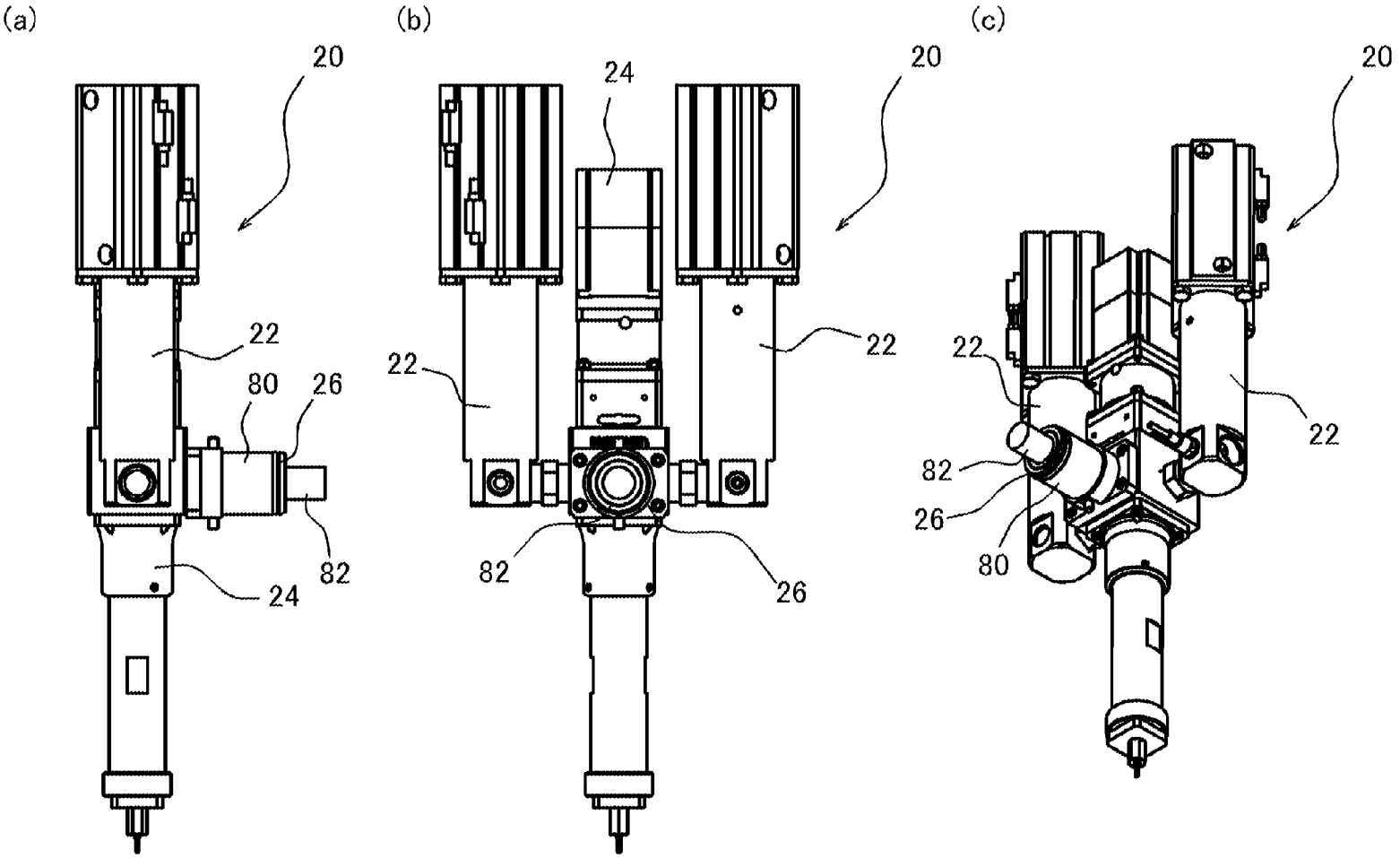

FIG. 14 are views each illustrating a first modified example of the discharge device illustrated in FIG. 2. FIGS. 14(*a*), 14(*b*), and 14(*c*) are a left side view, a front view, and a perspective view, respectively.

Figure 15:
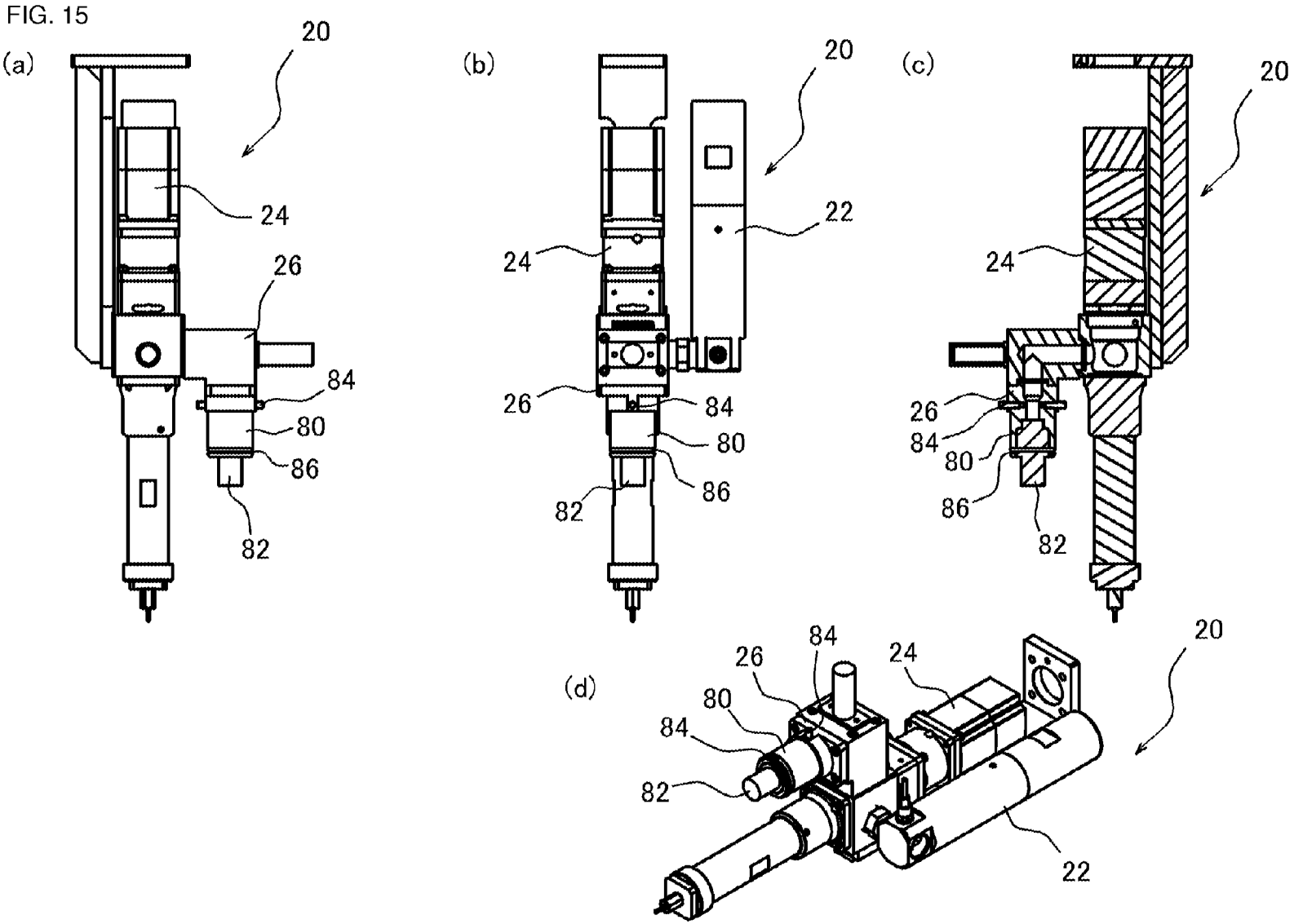

FIG. 15 are views each illustrating a second modified example of the discharge device illustrated in FIG. 2. FIGS. 15(*a*), 15(*b*), 15(*c*), and 15(*d*) are a left side view, a front view, a sectional view, and a perspective view, respectively.

Figure 16:
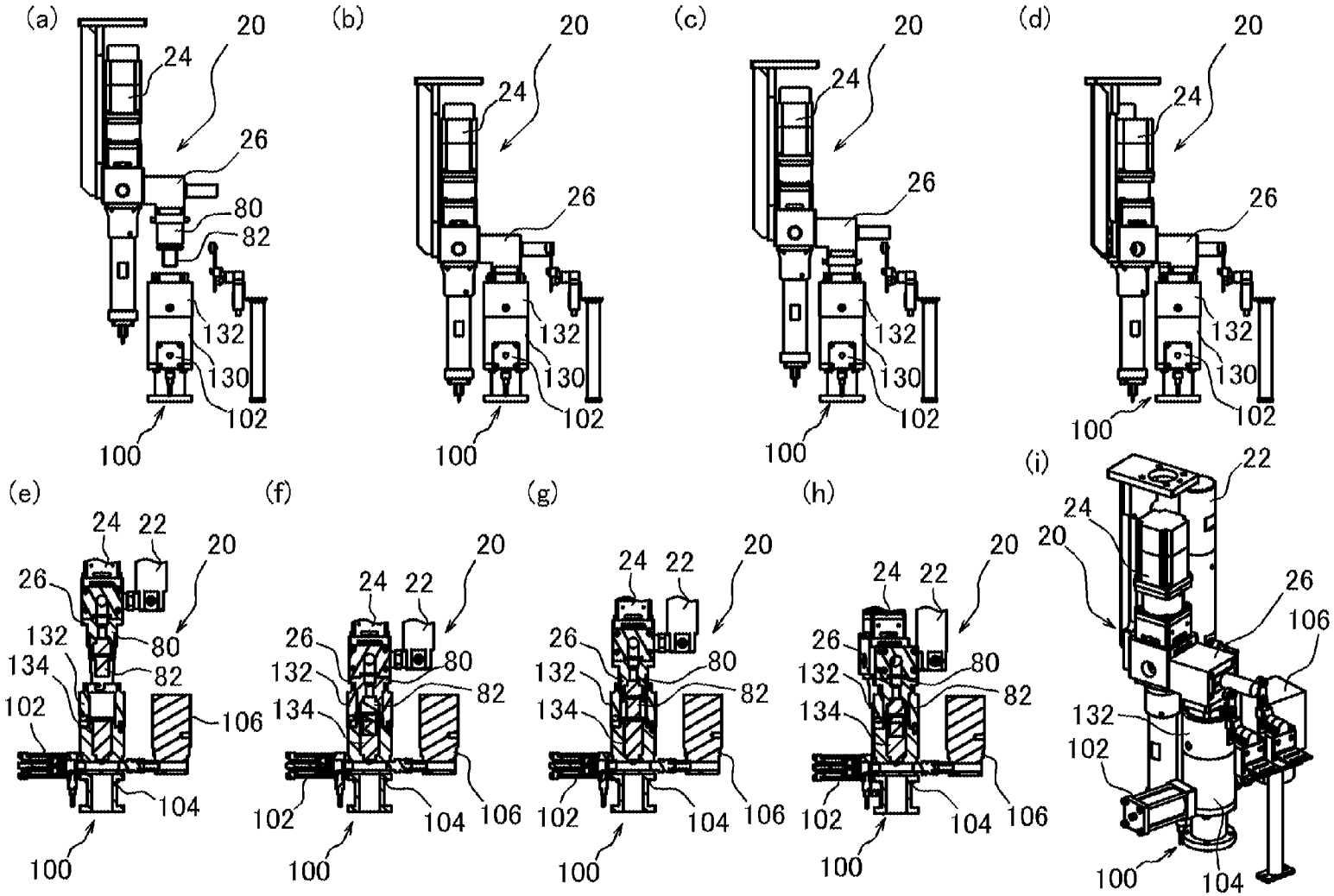

FIG. 16 are views illustrating a connecting operation of the discharge device and the filling device illustrated in FIG. 15 on a step-by-step basis. FIGS. 16(*a*), 16(*b*), 16(*c*), and 16(*d*) illustrate a state of the discharge device and the filling device when viewed from a left side. FIGS. 16(*e*), 16(*f*), 16(*g*), and 16(*h*) are respectively enlarged sectional views of main portions of FIGS. 16(*a*), 16(*b*), 16(*c*), and 16(*d*). FIG. 16(*i*) is a perspective view illustrating a state in which the discharge device and the filling device are connected to each other.

DESCRIPTION OF EMBODIMENTS

<<Regarding Device Configuration of Discharge System 10>>

Now, a discharge system 10 according to an embodiment of the present invention is described in detail with reference to the drawings. As illustrated in FIG. 1, the discharge system 10 includes, as main components, a discharge device 20, a filling device 100, a fluid feed source 160, and a control device 170. The discharge system 10 can fill a fluid fed from the fluid feed source 160 into the discharge device 20 by connecting the discharge device 20 to the filling device 100. Further, the discharge system 10 can discharge the fluid filled in the discharge device 20 for application or the like by operating the discharge device 20 in a state of being separated from the filling device 100. That is, the discharge system 10 has such a system configuration that, in a state in which a pipe, a hose, or the like for feeding the fluid is not connected to the discharge device 20, the discharge device 20 is operated independently from the filling device 100 and the fluid feed source 160 so that the fluid can be applied or the like.

As illustrated in FIG. 2, the discharge device 20 includes a discharge-side buffer portion 22 (buffer), a discharge portion 24, and a discharge-side mounting/demounting portion 26. The discharge-side buffer portion 22 is provided to buffer an internal pressure variation in the discharge device 20, which is caused when the discharge device 20 and the filling device 10 are connected to and separated from each other so as to fill a fluid for discharge into the discharge portion 24. The discharge-side buffer portion 22 can be formed of a container such as a tank, and in this embodiment, the discharge-side buffer portion 22 including a cylinder mechanism 30 as illustrated in FIG. 3 is adopted.

Figure 3:
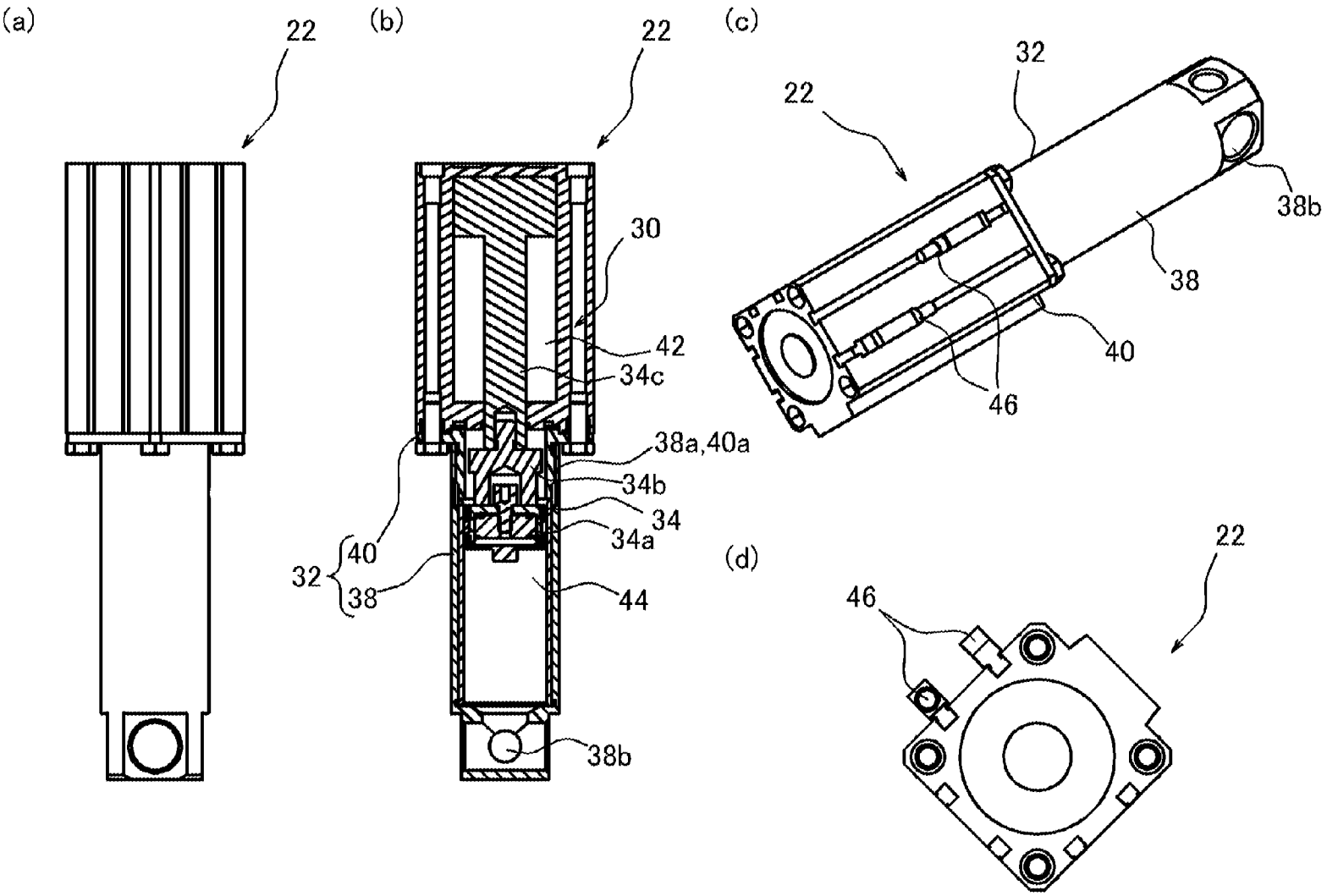
FIG. 3 are views each illustrating a discharge-side buffer portion adopted in the discharge device of FIG. 2. FIGS.

Specifically, as illustrated in FIG. 3(*b*), the discharge-side buffer portion 22 includes the cylinder mechanism 30 formed of a so-called air cylinder. The cylinder mechanism 30 includes a casing 32 and a piston 34. As illustrated in FIG. 3(*c*), the discharge-side buffer portion 22 can feed compressed air from an air feed source serving as a driving source.

As illustrated in FIG. 3(*b*), the casing 32 is a container formed of a combination of a lower casing 38 and an upper casing 40. In connected portions between the lower casing 38 and the upper casing 40, an internal thread 38*a* and an external thread 40*a* are formed, respectively, and the casing 32 is assembled by screwing the internal thread 38*a* and the external thread 40*a* to each other. Further, in a lower end portion (on an opposite side to the internal thread 38*a*) of the lower casing 38, a connecting portion 38*b* is formed.

In the casing 32, the piston 34 can freely slide in an axis line direction of the casing 32. The piston 34 has such a configuration that a piston rod 34*c* is connected to a piston main body 34*a* through intermediation of a piston adaptor 34*b*. The piston 34 partitions a space in the casing 32 into a first chamber 42 on the upper casing 40 side and a second chamber 44 on the lower casing 38 side. The first chamber 42 is a compartment into which the compressed air fed from the air feed source serving as the driving source is introduced through ports 46 formed in the casing 32, and the second chamber 44 is a compartment that allows outflow and inflow of the fluid. The cylinder mechanism 30 can change the capacity of the second chamber 44 by operating the driving source. The second chamber 44 communicates to the connecting portion 38*b* so as to allow outflow and inflow of the fluid with respect to the second chamber 44 through the connecting portion 38*b*.

Further, in the discharge buffer portion 22, position detection means (not shown) for detecting a position of the piston 34 is provided. The position detection means may be formed of any member. Specifically, as the position detection means, an automatic switch may be adopted, in which a contact point is switched between an ON state and an OFF state based on entering and leaving of a magnet (not shown) provided in the piston 34 with respect to a detection range, and the automatic switch may be provided at an upper limit position and a lower limit position of a movable range of the piston 34. Alternatively, a pressure sensor capable of detecting an internal pressure in the discharge buffer portion 22 can be adopted as the position detection means. In this case, an upper limit value and a lower limit value of the internal pressure are defined in advance. When the internal pressure reaches the upper limit value, it can be determined that the piston 34 has reached an upper limit position, and when the internal pressure reaches the lower limit value, it can be determined that the piston 34 has reached an upper limit position.

The discharge portion 24 is formed of a rotary displacement pump. In this embodiment, the discharge portion 24 is formed of a so-called uniaxial eccentric screw pump. The discharge portion 24 has such a configuration that a rotor 52, a stator 54, a power transmission mechanism 56, and the like are accommodated in a casing 50. The casing 50 is a tubular member made of a metal and has a first opening 60 on one end side in a longitudinal direction. Further, a second opening 62 is formed in an outer circumferential portion of the casing 50. The second opening 62 communicates to an inner space of the casing 50 in an intermediate portion 64 located in an intermediate part in the longitudinal direction of the casing 50.

The first opening 60 and the second opening 62 respectively serve as a suction port and a discharge port of the uniaxial eccentric screw pump forming the discharge portion 24. The first opening 60 and the second opening 62 of the discharge portion 24 are allowed to serve as the discharge port and the suction port, respectively, by rotating the rotor 52 in a forward direction. Further, the first opening 60 and the second opening 62 are allowed to serve as the suction port and the discharge port, respectively, by rotating the rotor 52 in a backward direction for maintenance and the like, and thus the inner space of the casing 50 and the like can be cleaned and the like.

The stator 54 is a member formed of an elastic body such as a rubber, a resin, or the like, having a substantially cylindrical outer appearance. An inner circumferential wall 66 of the stator 54 is formed into a single-stage or multistage internal thread shape with "n" starts . In this embodiment, the stator 54 is formed into a multistage internal thread shape with two starts. Further, a through hole 68 of the stator 54 is formed so that a sectional shape (opening shape) becomes a substantially oval shape in a sectional view at any position in the longitudinal direction of the stator 54.

The rotor 52 is a shaft member made of a metal and is formed into a single-stage or multistage external thread shape with (n−1) starts. In this embodiment, the rotor 52 is formed into an eccentric external thread shape with a single start. The rotor 52 is formed so that a sectional shape becomes a substantially true circle shape in a sectional view at any position in the longitudinal direction of the rotor 52. The rotor 52 is inserted in the through hole 68 formed in the stator 54 so that the rotor 52 can freely rotate eccentrically in the through hole 68.

When the rotor 52 is inserted in the stator 54, an outer circumferential wall 70 of the rotor 52 and the inner circumferential wall 66 of the stator 54 are brought into close contact with each other at tangents of both the rotor 52 and the stator 54, and thereby a fluid conveyance path 72 (cavity) is formed between the inner circumferential wall 66 of the stator 54 and the outer circumferential wall 70 of the rotor 52. The fluid conveyance path 72 extends in a helical shape in the longitudinal direction of the stator 54 and the rotor 52.

When the rotor 52 is rotated in the through hole 68 of the stator 54, the fluid conveyance path 72 proceeds in the longitudinal direction of the stator 54 while rotating in the stator 54. Therefore, when the rotor 52 is rotated, the fluid is sucked into the fluid conveyance path 72 from one end side of the stator 54, and the fluid can be transferred toward the other end side of the stator 54 while being confined in the fluid conveyance path 72 and discharged to the other end side of the stator 54.

The power transmission mechanism 56 transmits power from a driving device 74 to the rotor 52. The power transmission mechanism 56 includes a power transmission portion 76 and an eccentric rotation portion 78. The power transmission portion 76 is formed on one end side in the longitudinal direction of the casing 50. Further, the eccentric rotation portion 78 is formed in the intermediate portion 64. The eccentric rotation portion 78 connects the power transmission portion 76 and the rotor 52 to each other so that power can be transmitted. The eccentric rotation portion 78 includes a coupling shaft 98 formed of a related-art well-known coupling rod, a screw rod, or the like. Therefore, the eccentric rotation portion 78 can transmit rotation power generated by the operation of the driving device 74 to the rotor 52, to thereby rotate the rotor 52 eccentrically.

As illustrated in FIG. 2, the discharge-side mounting/demounting portion 26 is connected to the casing 50 forming the discharge portion 24. As illustrated in FIGS. 2(*c*) and 2(*d*), the discharge-side mounting/demounting portion 26 has such a configuration that a discharge-side connector 82 and a pin 84 are mounted on a discharge-side mounting/demounting portion main body 80. The discharge-side mounting/demounting portion main body 80 has such a configuration that a rectangular connecting portion 80*b* is formed on a base end section of a cylindrical tubular portion 80*a*. A fitting portion 80*c* for allowing the discharge-side connector 82 to be fitted therein is formed on a tip end side of the tubular portion 80*a*. Further, a communication path 80*d* is formed in the tubular portion 80*a* so as to pass through the tubular portion 80*a* from the fitting portion 80*c* to the connecting portion 80*b*. The discharge-side mounting/demounting portion main body 80 is mounted on the casing 50 in a state of being positioned so that the communication path 80*d* and the second opening 62 formed in the discharge portion 24 communicate to each other. A sealing member 86 such as an O-ring is mounted on an outer circumferential portion on the tip end side of the tubular portion 80*a*.

As described later in detail, the discharge-side connector 82 is combined with a filling-side connector 134 provided in the filling device 100, to thereby form a connecting device 140 for connecting the discharge device 20 and the filling device 100 to each other. The discharge-side connector 82 is a male plug to be plugged into the filling-side connector 134. The discharge-side connector 82 is fitted into the fitting portion 80*c* formed in the tubular portion 80*a* of the discharge-side mounting/demounting portion main body 80 so as to communicate to the communication path 80*d*.

As described later in detail, the pin 84 is combined with a hook-like slit 144 formed on the filling device 100 side to form a separation preventing mechanism 150. The pin 84 is used for positioning the discharge device 20 and the filling device 100 when connecting the discharge device 20 and the filling device 100 to each other so that the separation of the discharge device 20 and the filling device 100 is suppressed. The pin 84 is provided so as to protrude in a substantially vertical direction with respect to the outer circumferential surface of the tubular portion 80*a* at a position on the base end side (connecting portion 80*b* side) of the tubular portion 80*a*. Two pins 84 are provided on the tubular portion 80*a* at an interval of about 180° in the circumferential direction.

As illustrated in FIG. 1, the discharge device 20 is mounted on a manipulator 90 having a degree of freedom of a plurality of axes as in a so-called articulated robot or the like. Therefore, the fluid can be applied to various components and the like in accordance with an application pattern of the fluid defined in advance by causing the discharge device 20 to discharge the fluid while moving the discharge device 20 with the manipulator 90. Further, the discharge device 20 and the filling device 100 can be connected to each other by moving the discharge device 20 with the manipulator 90 in the order illustrated in FIGS. 9 to 12 and the like and bringing the discharge-side connector 82 close to the filling-side connector 134 described later in detail in a state of positioning the discharge-side connector 82 and the filling-side connector 134. The discharge device 20 and the filling device 100 can be separated from each other by performing an operation opposite to the foregoing.

The filling device 100 serves as a filling station for filling the fluid into the discharge device 20. As illustrated in FIGS. 1 and 5, the filling device 100 includes a filling-side buffer portion 102 (buffer), a filling-side mounting/demounting portion 104, and a valve 106. The filling-side buffer portion 102 is provided to buffer an internal pressure variation in the filling device 100, which is caused when the discharge device 20 and the filling device 100 are connected to and separated from each other so as to fill the fluid into the discharge portion 24. The filling-side buffer portion 102 can be formed of a container such as a tank or can include the cylinder mechanism 30 in the same way as in the above-mentioned discharge-side buffer portion 22. In this embodiment, the filling-side buffer portion 102 includes an absorber mechanism 110 as illustrated in FIG. 6(*d*).

Specifically, the absorber mechanism 110 includes a casing 112, a piston 114, and a spring 116, and is configured to be operated through use of the elastic force of the spring 116. The casing 112 is a cylindrical tubular body and includes a connecting portion 118 on one end side in an axis line direction of the casing 112. Further, in the casing 112, the piston 114 can freely slide in the axis line direction of the casing 112. The piston 114 has such a configuration that a piston rod 114*b* is connected to a piston main body 114*a*. An inner space of the casing 112 is partitioned into a first camber 120 on one side and a second chamber 122 that communicates to the connecting portion 118 on the other side, through intermediation of the piston main body 114*a*. The spring 116 is provided in the second chamber 122. Thus, the piston main body 114*a* is biased to the first chamber 120 side. When the fluid flows in the casing 112 through the connecting portion 118, the piston main body 114*a* is pushed back toward the second chamber 122 against the biasing force of the spring 116, and thereby the first chamber 120 expands.

As illustrated in FIG. 5, the filling-side mounting/demounting portion 104 has such a configuration that a sealed space forming member 132 (closed space forming member) is connected to be integrated with a filling-side mounting/demounting portion main body 130. As illustrated in FIG. 5(*d*), the filling-side mounting/demounting portion main body 130 includes a hollow fitting portion 130*a* and a connecting portion 130*b* that is formed so as to be continued from the fitting portion 130*a* and protrude toward a top surface side. The filling-side connector 134 described later in detail is fitted into the fitting portion 130*a* so as to be integrated therewith. Further, a sealing member 136 such as an O-ring is mounted on an outer circumferential portion of the connecting portion 130*b*.

Further, the filling-side mounting/demounting portion main body 130 includes a communication path 130*c* formed so as to communicate to the fitting portion 130*a*. Further, connecting ports 130*d* and 130*e* are formed at both ends of the communication path 130*c*. The connecting portion 118 of the filling-side buffer portion 102 is connected via piping to the connecting port 130*d*. Further, the valve 106 is connected via piping to the connecting port 130*e*.

The filling-side connector 134 is combined with the discharge-side connector 82 provided on the discharge device 20 side, to thereby form the connecting device 140 for connecting the discharge device 20 and the filling device 100 to each other. The filling-side connector 134 is a female socket into which the discharge-side connector 82 is plugged. The filling-side connector 134 contains a valve mechanism (not shown) such as a stop valve mechanism. The filling-side connector 134 is fitted into the fitting portion 130*a* of the filling-side mounting/demounting portion main body 130 so as to be integrated therewith and communicates to the communication path 130*c* formed in the filling-side mounting/demounting portion main body 130.

As illustrated in FIG. 5, the sealed space forming member 132 is a tubular member to be connected to the top surface side of the filling-side mounting/demounting portion main body 130 in a removable manner. Specifically, the sealed space forming member 132 is integrated with the filling-side mounting/demounting portion main body 130 by inserting bolts 138 in a plurality of (four in this embodiment) bolt insertion holes 132*a*, which are formed in a circumferential direction of the sealed space forming member 132 so as to extend in an axis line direction thereof, and fastening each bolt 138 in a corresponding screw hole 130*f* formed through the top surface of the filling-side mounting/demounting portion main body 130. When the filling-side mounting/demounting portion main body 130 and the sealed space forming member 132 are integrated with each other, a positioning pin 142 is mounted through a pin hole (not shown) formed through a bottom surface (filling-side mounting/demounting portion main body 130 side) of the sealed space forming member 132 and a pin hole 130*g* formed through the top surface side of the filling-side mounting/demounting portion main body 130. With this, the filling-side mounting/demounting portion main body 130 and the sealed space forming member 132 are connected to each other in a state of being positioned so as to have a predetermined positional relationship in the circumferential direction. Further, the filling-side mounting/demounting portion main body 130 and the sealed space forming member 132 are sealed together with the sealing member 136 mounted on the outer circumferential portion of the connecting portion 130*b*.

The hook-like slit 144 is formed in an upper end portion (end portion on an opposite side to the filling-side mounting/demounting portion main body 130) of the tubular body forming the sealed space forming member 132. The hook-like slit 144 is combined with the pin 84 provided on the discharge device 20 side to form the separation preventing mechanism 150. The separation preventing mechanism 150 is a mechanism for holding the discharge device 20 and the filling device 100 so as not to be separated from each other due to the force to be applied when the fluid is filled into the discharge device 20 from the filling device 100. Specifically, the hook-like slit 144 is a slit having a substantially "L"-shape in a front view and continuously includes a slit portion opened toward the upper end portion of the sealed space forming member 132 and a slit portion formed so as to extend in the circumferential direction of the sealed space forming member 132. Thus, by plugging the discharge-side mounting/demounting portion 26 into the sealed space forming member 132 in a state of positioning the pin 84 provided on the discharge-side mounting/demounting portion 26 of the discharge device 20 with the hook-like slit 144 and rotating the discharge-side mounting/demounting portion 26 in the circumferential direction, the pin 84 can be engaged with the hook-like slit 144 so as not to come off from the hook-like slit 144.

An exhaust port (not shown) is formed in an outer circumferential portion of the sealed space forming member 132. The exhaust port is connected so as to cause the inside and outside of the sealed space forming member 132 to communicate to each other. As illustrated in FIG. 1, the sealed space forming member 132 is connected to a decompression device 148 such as a vacuum pump through the exhaust port.

The fluid feed source 160 can pump up the fluid from a reservoir 162 storing the fluid and pump the fluid to the filling device 100. The fluid feed source 160 is connected via piping to the valve 106 provided at the filling device 100. Therefore, the feed of the fluid to the filling device 100 can be controlled by appropriately opening or closing the valve 106.

The control device 170 is used for controlling the operation of each component forming the discharge system 10, such as the discharge device 20, the manipulator 90, the filling device 100, and the fluid feed source 160. The control device 170 can control operations such as the fluid discharge operation of the discharge device 20, the operation of the manipulator 90, and the fluid filling operation performed mainly by the discharge device 20 and the filling device 100.

<<Regarding Operation of Discharge System 10>>

Now, the operation of the discharge system 10 is described mainly with a focus on the fluid filling operation with respect to the discharge device 20 with reference to a flowchart of FIG. 7 and a timing chart of FIG. 8. In the discharge system 10, in Step 1, the discharge device 20 is operated to perform a fluid discharge operation. After the operation of the discharge device 20, in Step 2, in the case where the control device 170 determines that a request for filling the fluid into the discharge device 20 has been output, a control flow proceeds to Step 3. In this case, it can be determined whether or not there is a request for filling the fluid into the discharge device 20 based on various determination criteria. For example, under such a condition that the pressure sensor (not shown) capable of detecting the internal pressure in the discharge-side buffer portion 22 provided in the discharge device 20 shows a value equal to or less than a predetermined pressure, it can be determined that the piston 34 has reached the lower limit position in the discharge-side buffer portion 22, and a request for filling of the fluid has been turned on. Further, in the case of adopting, as the position detection means, an automatic switch that is turned on/off depending on the position of the piston 34, when it is determined that the piston 34 has reached the lower limit position based on the detection result of the automatic switch, it can be determined that a request for filling of the fluid has been turned on.

In Step 2, when it is determined that there is a request for filling of the fluid, and the control flow proceeds to Step 3, the manipulator 90 moves the discharge device 20 to the filling device 100 side as illustrated in FIG. 9. After that, as illustrated in FIG. 10, the tubular portion 80*a* of the discharge-side mounting/demounting portion main body 80 provided on the discharge device 20 side is plugged into the tubular sealed space forming member 132 provided on the filling device 100 side from the upper end portion. In this stage (Step 3), as illustrated in FIG. 10(*b*), the discharge-side connector 82 on the discharge device 20 side and the filling-side connector 134 are not connected to each other. In this state, on an upper end side of the sealed space forming member 132, a gap between the outer circumferential surface of the tubular portion 80*a* and an inner circumferential surface of the sealed space forming member 132 is sealed with the sealing member 86 mounted on the outer circumference of the tubular portion 80*a*. On the other hand, on a lower end side of the sealed space forming member 132, a gap between an outer circumferential surface of the connecting portion 130*b* and the inner circumferential surface of the sealed space forming member 132 is sealed with the sealing member 136 mounted on the outer circumference of the connecting portion 130*b*. Thus, in the state of Step 3, a sealed space 135 is formed on an inner side of the sealed space forming member 132, and the discharge-side connector 82 and the filling-side connector 134 are arranged in a disconnected state in the sealed space 135.

When the sealed space 135 is formed in the sealed space forming member 132 as described above, the control flow proceeds to Step 4. In Step 4, in order to bring the sealed space 135 into a substantially vacuum state, the decompression device 148 connected via piping to an exhaust port 146 of the sealed space forming member 132 is operated to start vacuuming. Note that, the detection of the connected state between the tubular portion 80*a* and the sealed space forming member 132, which is a trigger to cause the start of vacuuming, can be performed by various methods. Specifically, a vacuum start limit switch 172 for detecting the insertion of the tubular portion 80*a* in the sealed space forming member 132 may be provided at a position adjacent to the filling device 100 as illustrated in FIG. 13, and based on a signal output from the vacuum start limit switch 172, the control device 170 can determine that the tubular portion 80*a* has been inserted in the sealed space forming member 132 to form the sealed space 135.

After the start of vacuuming in Step 4, in Step 5, when a vacuum sensor (not shown) for detecting a vacuum degree of the sealed space 135 confirms that the vacuum degree has reached an intended vacuum degree, the control flow proceeds to Step 6. In Step 6, due to the operation control of the manipulator 90 by the control device 170, the discharge device 20 moves in an axis line direction of the discharge-side connector 82 to come close to the filling device 100. In this case, the control device 170 outputs a signal (operation speed control signal) for controlling the operation speed to the manipulator 90 so that the discharge device 20 comes close to the filling device 100 at a predetermined speed V1. With this, as illustrated in FIG. 11, in the sealed space 135, the discharge-side connector 82 and the filling-side connector 134 come close to each other at the speed V1, and thereby the discharge-side connector 82 and the filling-side connector 134 (connecting device 140) are connected to each other.

When the connecting device 140 is brought into a connected state, in Step 7, the separation preventing mechanism 150 is brought into a locked state. Specifically, when the discharge-side connector 82 and the filling-side connector 134 are connected to each other in Step 6, the pin 84 provided on an outer circumferential portion of the discharge-side mounting/demounting portion main body 80 also proceeds in the axis line direction of the sealed space forming member 132 to enter the hook-like slit 144 formed in the sealed space forming member 132 as illustrated in FIG. 12(*c*). In Step 7, the manipulator 90 turns the discharge device 20 in the circumferential direction of the sealed space forming member 132 as indicated by the arrow in FIG. 12(*a*), and thus the discharge device 20 is rotated as illustrated in FIG. 12(*b*). In addition, the pin 84 moves along the hook-like slit 144 to be engaged therewith as illustrated in FIG. 12(*d*). With this, the separation preventing mechanism 150 is brought into a locked state. It can be detected by various methods that the pin 84 has reached the vicinity of a trailing end portion of the hook-like slit 144 to bring the separation preventing mechanism 150 into a locked state. Specifically, a docking completion limit switch 174 for detecting that the discharge device 20 has been rotated up to a position at which the pin 84 reaches the vicinity of the trailing end portion of the hook-like slit 144 may be provided at a position adjacent to the filling device 100 as illustrated in FIG. 13, and based on a signal output from the docking completion limit switch 174, it can be detected whether or not the separation preventing mechanism 150 is in a locked state.

When the connection of the connecting device 140 is completed as described above, and the separation preventing mechanism 150 is brought into a locked state, in Step 8, the decompression device 148 is stopped to end vacuuming. After that, the control flow proceeds to Step 9, and the filling of the fluid from the filling device 100 into the discharge device 20 is started. Specifically, in Step 9, the valve 106 provided in the filling device 100 is opened, and the fluid pumped from the fluid feed source 160 is pumped to the discharge device 20 side through the connecting device 140 formed of the discharge-side connector 80 and the filling-side connector 134. The fluid pumped to the discharge device 20 side is filled into the casing 50 of the discharge portion 24 through the discharge-side mounting/demounting portion 26. In this case, as described above, the discharge-side buffer portion 22 and the filling-side buffer portion 102 are provided in the discharge device 20 and the filling device 100, respectively. Thus, the internal pressure variation caused by the filling of the fluid into the discharge device 20 from the filling device 100 is buffered, and the internal pressure in the discharge device 20 and the filling device 100 can be maintained at a low pressure in the vicinity of the atmospheric pressure.

When the filling of the fluid is started as described above, the control flow proceeds to Step 10, and the control device 170 confirms whether or not the fluid has been filled into the discharge device 20 side in a full state. In this case, as the method of detecting that the fluid has been sufficiently filled into the discharge device 20 and the like, there may be given various methods. Specifically, under such a condition that the pressure sensor (not shown) for detecting the internal pressure in the discharge-side buffer portion 22 of the discharge device 20 shows a value equal to or more than a predetermined pressure, it can be determined that the fluid has been sufficiently filled, and a request for filling has been turned off. Further, in the case of adopting, as the position detection means, an automatic switch that is turned on/off depending on the position of the piston 34, when the piston 34 has reached a detection region of the automatic switch provided at the upper limit position, and the automatic switch at the upper limit position is turned on, it can be determined that a request for filling of the fluid has been turned off.

In Step 10, when it is confirmed that the fluid has been filled into the discharge device 20 in a full state, the control flow proceeds to Step 11, and the valve 106 is closed. Thus, the filling of the fluid into the discharge device 20 from the filling device 100 is completed. When the filling of the fluid is completed as described above, the control flow proceeds to Step 12, and the separation preventing mechanism 150 is cancelled. Specifically, the manipulator 90 is operated to turn the discharge device 20 in a direction opposite to the direction in the case where the separation preventing mechanism 150 is brought into a locked state in Step 7, and thereafter the discharge device 20 is separated from the filling device 100 in an axis line direction. Thus, when the pin 84 comes off from the hook-like slit 144, the lock of the separation preventing mechanism 150 is cancelled.

When the lock cancellation of the separation preventing mechanism 150 is completed, the control flow proceeds to Step 13. In Step 13, the discharge device 20 further moves in a direction in which the discharge device 20 is separated from the filling device 100 in the axis line direction. In this case, the control device 170 outputs a signal (operation speed control signal) for controlling the operation speed to the manipulator 90 so that the discharge device 20 is separated from the filling device 100 at a predetermined speed V2. The separation speed V2 is set to be equal to or less than the connection speed V1 in Step 6 described above ($|V1| \geq |V2|$). With this, the discharge-side connector 82 and the filling-side connector 134 are separated from each other at the speed V2 equal to or less than the speed at a time of the connecting operation, and the discharge-side connector 82 comes off from the filling-side connector 134 to cancel the connection. Accordingly, a series of operation flows are completed.

As described above, in the discharge system 10 according to this embodiment, the operation speed control signal is output from the control device 170 during the connecting operation and the separating operation of the discharge device 20 and the filling device 100 so as to control the operation speed during the separating operation to be equal to or lower than the operation speed during the connecting operation. By performing such an operation control, the fluid can be sufficiently scraped off in the connecting device 140 during the separating operation, and thereby the leakage amount and the adhesion amount of the fluid to an outside can be minimized. Further, a period of time required for the series of the filling operation of the fluid from the connection to the separation of the discharge device 20 and the filling device 100 can be minimized, and thus operation efficiency can be enhanced.

In the discharge system 10 according to this embodiment, the discharge device 20 and the filling device 100 include the discharge-side buffer portion 22 and the filling-side buffer portion 102, respectively, as the buffer for buffering an internal pressure variation caused by the connection and separation of the discharge device 20 and the filling device 100. With this, the internal pressure variation in the discharge device 20 and the filling device 100 is buffered during the connecting and separating operations of the discharge device 20 and the filling device 100, and the connecting and separating operations can be performed under a low-pressure condition. Thus, in the discharge system 10 according to this embodiment, such a situation can be suppressed that the fluid leaks to an outside of the connecting device 140 to adhere to a surface thereof and the like during the connecting operation and the separating operation of the discharge device 20 and the filling device 100.

Further, in the discharge system 10, the discharge-side buffer portion 22 including the cylinder mechanism is provided as the buffer on the discharge device 20 side. In the discharge-side buffer portion 22, the cylinder 34 ascends along with the inflow of the fluid into the second chamber 44 during the filling operation, and the capacity of the second chamber 44 increases. The discharge-side buffer portion 22 is operated as described above. With such a configuration, the internal pressure variation in the discharge device 20 caused by the connecting and separating operations of the discharge device 20 and the filling device 100 is suppressed, and the connecting and separating operations can be performed under a low-pressure condition. Thus, the fluid can be prevented from leaking and adhering to an outside of the discharge-side connector 82 during the connecting and separating operations of the discharge device 20 and the filling device 100.

Further, in the discharge system 10 according to this embodiment, the filling-side buffer portion 102 including the absorber mechanism that is operated through use of the biasing force of the spring 116 is provided as the buffer on the filling device 100 side. With this, the internal pressure variation in the filling device 100 caused by the connection and separation of the discharge device 20 and the filling device 100 is minimized, and the filling operation can be performed under a low-pressure condition. Thus, the fluid can be prevented from leaking and adhering to an outside of the filling-side connector 134.

In this embodiment, although there is exemplified a case in which the buffer including the cylinder mechanism is adopted as the discharge-side buffer portion 22 on the discharge device 20 side, and the buffer including the absorber mechanism is provided as the filling-side buffer portion 102 on the filling device 100 side, the present invention is not limited thereto. Specifically, as the buffer to be provided on the discharge device 20 side, a member comparable to the filling-side buffer portion 102 including the absorber mechanism may be provided. Similarly, as the buffer to be provided on the filling device 100 side, a member comparable to the discharge-side buffer portion 22 including the cylinder mechanism may be provided. Further, one or both of the discharge-side buffer portion 22 and the filling-side buffer portion 102 may not be provided.

In this embodiment, although there is exemplified a case in which one buffer forming the discharge-side buffer portion 22 is provided in the discharge device 20, and one buffer forming the filling-side buffer portion 102 is provided in the filling device 100, the present invention is not limited thereto. Specifically, as illustrated in FIG. 14, the discharge system 10 may be configured so that the discharge device 20 includes two or more buffers forming the discharge-side buffer portion 22.

In this embodiment, although the discharge-side buffer portion 22 including the cylinder mechanism and the discharge-side buffer portion 22 including the absorber mechanism are exemplified as examples of the buffers to be provided in the discharge device 20 and the filling device 100, the present invention is not limited thereto, and the buffers maybe formed of another type of accumulator or a tank capable of allowing outflow and inflow of the fluid. This configuration also minimizes the internal pressure variation in the discharge device 20 and the filling device 100 caused by the connecting and separating operations to maintain the insides of the discharge device 20 and the filling device 100 at a low pressure (substantially atmospheric pressure), and thus the outside leakage of the fluid can be minimized.

Note that, in this embodiment, although there is exemplified a case in which the sealed space 135 can be formed by the sealed space forming member 132 in order to achieve the purpose of preventing the mixing of air into the discharge device 20 or the filling device 100 during the filling step of the fluid and a discharge failure of the fluid caused by the mixing of air, the present invention is not limited thereto. Specifically, in the case where it is not necessary to consider a discharge failure caused by the mixing of air, the mixing of air can be prevented by another measure, or the like, a member (closed space forming member) capable of forming a closed space having sealability lower than that of the sealed space forming member 132 may be provided in place of the sealed space forming member 132. Further, in the case where it is not necessary to consider the scattering of a small amount of the leaking fluid and the like, the sealed space forming member 132 or the closed space forming member may not be provided.

The discharge system 10 according to this embodiment includes the separation preventing mechanism 150 formed of the positioning pin 142 and the hook-like slit 144. With this, the discharge device 20 can be reliably prevented from being separated from the filling device 100 in a state of being connected to the filling device 100 so as to fill the fluid into the discharge device 20. Note that, the separation preventing mechanism 150 exemplified in this embodiment is merely an example, and a catch typified by a related-art well-known ball catch, a hook, a fastener, or the like may also be used as the separation preventing mechanism 150.

The discharge system 10 adopts the uniaxial eccentric screw pump as the discharge portion 24 of the discharge device 20. Therefore, the fluid filled into the discharge device 20 from the filling device 100 can be discharged quantitatively and stably without pulsating or the like. Further, in the discharge system 10, there is also no risk in that the fluid may adhere to a surface of the discharge-side connector 82 and the like during the filling operation. Therefore, the discharge system 10 has extremely high discharge performance of the fluid and can avoid such degradation in quality that the fluid adhering to the discharge-side connector 82 drops to various components and the like to be applied with the fluid. Thus, the discharge system 10 can be preferably used for purposes of applying a fluid such as a sealant or an adhesive to various components in an automobile assembly plant or the like.

In the discharge system 10 described above, the axis line direction of the discharge-side connector 82 provided in the discharge-side mounting/demounting portion 26 of the discharge device 20 intersects with (is substantially orthogonal to) the axis line direction of the discharge portion 24. Therefore, when the discharge device 20 is connected to the filling device 100 set on a floor, the discharge device 20 is lowered to the filling device 100 side in a state in which the discharge portion 24 is held in a substantially horizontal posture, and the discharge-side connector 82 is pressed into the filling-side connector 134. Thus, in order to enable the discharge-side connector 82 to be pressed into the filling-side connector 134 accurately without involving the complicated operation of the manipulator 90 in the case where the discharge device 20 is configured as described above, it is desired that an arm of the manipulator 90 be mounted at a position on the axis line of the discharge-side connector 82 in the discharge portion 24.

In contrast, in the case where the arm of the manipulator 90 is mounted on a portion of the axis line of the discharge portion 24 such as an upper end portion of the discharge portion 24, it is desired that the axis line direction of the discharge-side connector 82 be arranged to be along (in the illustrated state, substantially parallel to) the axis line direction of the discharge portion 24 as illustrated in FIG. 15. With such a configuration, as illustrated in FIGS. 16(*a*) to 16(*i*), the discharge device 20 is lowered to the filling device 100 side in a state in which the discharge portion 24 is held in a substantially vertical posture, and the discharge-side connector 82 is pressed into the filling-side connector 134 without involving the complicated operation of the manipulator 90 so as to connect the discharge-side connector 82 and the filling-side connector 134 to each other. Thus, the filling operation of the fluid can be performed.

INDUSTRIAL APPLICABILITY

The application system of the present invention can be used preferably for purposes of applying a fluid such as a sealant or an adhesive to various components in an automobile assembly plant or the like, filling a fluid such as grease into a container, and the like.

REFERENCE SIGNS LIST

10 discharge system
20 discharge device
22 discharge-side buffer portion
32 casing
34 piston
36 driving source
42 first chamber
44 second chamber
52 rotor
54 stator
82 discharge-side connector
100 filling device
102 filling-side buffer portion
112 casing
114 piston
116 spring
120 first chamber
122 second chamber
132 sealed space forming member
134 filling-side connector
135 sealed space
140 connecting device
148 decompression device
150 separation preventing mechanism

Drawings

FIG. 7
Step 1 Operate Discharge Device
Step 2 Is There Request for Filling of Fluid?
Step 3 Move to Filling Device Form Sealed Space
Step 4 Start Vacuuming
Step 5 Is Vacuum Attained?
Step 6 Connect Connecting Device
Step 7 Lock Separation Preventing Mechanism
Step 8 End Vacuuming
Step 9 Start Filling of Fluid
Step 10 Is Fluid in Full State?
Step 11 Complete Filling of Fluid
Step 12 Cancel Separation Preventing Mechanism
Step 13 Cancel Connection of Connecting Device FIG. 8
(1) Applicator
(2) Request for Filling
(3) Vacuum Limit Switch
(4) Decompression Device
(5) Vacuum Sensor
(6) Docking Completion Limit Switch
(7) Valve
(8) Filled Amount Detection Means
(9) Discharge of Fluid
(10) Movement Connection of Connecting Device
(11) Wait for Vacuum
(12) Connection of Separation Preventing Mechanism
(13) Cancellation of Vacuum Filling of Fluid
(14) Cancellation of Separation Preventing Mechanism

The invention claimed is:

1. A discharge system, comprising:
a discharge device capable of discharging a fluid;
a filling device capable of filling the fluid into the discharge device; and
a control device,
wherein the fluid is filled into the discharge device from the filling device by connecting the discharge device and the filling device to each other,
wherein the fluid is dischargeable from the discharge device in a state in which the discharge device and the filling device are separated from each other,
wherein an operation speed during a connecting operation and an operation speed during a separating operation are controlled based on an operation speed control signal output from the control device, the connecting operation connecting the discharge device to the filling device, the separating operation separating the discharge device from the filling device that have been connected to each other, and
wherein the operation speed control signal is output from the control device so that the operation speed during the separating operation becomes equal to or less than the operation speed during the connecting operation.

2. A discharge system according to claim 1, wherein the discharge device and/or the filling device comprises a buffer for buffering an internal pressure variation caused by connection and/or separation of the discharge device and the filling device.

3. A discharge system according to claim 2,
wherein the buffer comprises an absorber mechanism comprising a casing, a piston mounted in the casing in a slidable manner, and biasing means for biasing the piston, and
wherein an inside of the casing is partitioned by the piston into a first chamber and a second chamber that allows outflow and inflow of the fluid, and the piston is biased by the biasing means in a direction of reducing a capacity of the second chamber.

4. A discharge system according to claim 3,
wherein the buffer comprises a cylinder mechanism comprising a casing, a piston mounted in the casing in a slidable manner, and a driving source for slidably driving the piston, and
wherein an inside of the casing is partitioned by the piston into a first chamber and a second chamber that allows outflow and inflow of the fluid, and a capacity of the second chamber is capable of being varied by operating the driving source.

5. A discharge system according to claim 3, wherein the buffer comprises a tank capable of allowing outflow and inflow of the fluid.

6. A discharge system according to claim 2,
wherein the buffer comprises a cylinder mechanism comprising a casing, a piston mounted in the casing in a slidable manner, and a driving source for slidably driving the piston, and
wherein an inside of the casing is partitioned by the piston into a first chamber and a second chamber that allows outflow and inflow of the fluid, and a capacity of the second chamber is capable of being varied by operating the driving source.

7. A discharge system according to claim 6, wherein the buffer comprises a tank capable of allowing outflow and inflow of the fluid.

8. A discharge system according to claim 2, wherein the buffer comprises a tank capable of allowing outflow and inflow of the fluid.

9. A discharge system according to claim 1, further comprising a separation preventing mechanism for preventing separation of the discharge device connected to the filling device.

10. A discharge system according to claim 1, wherein the discharge device comprises a uniaxial eccentric screw pump comprising: an external thread-shaped rotor configured to receive power to rotate eccentrically; and a stator having an inner circumferential surface formed into an internal thread shape.

* * * * *